US009087501B2

(12) United States Patent
Maezawa

(10) Patent No.: US 9,087,501 B2
(45) Date of Patent: Jul. 21, 2015

(54) SOUND SIGNAL ANALYSIS APPARATUS, SOUND SIGNAL ANALYSIS METHOD AND SOUND SIGNAL ANALYSIS PROGRAM

(71) Applicant: YAMAHA CORPORATION, Hamamatsu-shi, Shizuoka-ken (JP)

(72) Inventor: Akira Maezawa, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/207,816

(22) Filed: Mar. 13, 2014

(65) Prior Publication Data

US 2014/0260911 A1 Sep. 18, 2014

(30) Foreign Application Priority Data

Mar. 14, 2013 (JP) ..... 2013-051159

(51) Int. Cl.
*G10H 1/00* (2006.01)
*G10H 7/00* (2006.01)

(52) U.S. Cl.
CPC ..... *G10H 7/002* (2013.01); *G10H 1/00* (2013.01); *G10H 7/00* (2013.01); *G10H 2210/046* (2013.01); *G10H 2210/061* (2013.01); *G10H 2210/076* (2013.01); *G10H 2210/101* (2013.01); *G10H 2210/375* (2013.01)

(58) Field of Classification Search
USPC ..... 84/612, 636, 652
IPC ..... G10H 1/00,7/00, 2210/046, 2210/061, G10H 2210/076
See application file for complete search history.

(56) References Cited

U.S. PATENT DOCUMENTS

| | | | | |
|---|---|---|---|---|
| 5,491,751 | A * | 2/1996 | Paulson et al. | 705/51 |
| 5,585,585 | A * | 12/1996 | Paulson et al. | 84/610 |
| 5,808,219 | A | 9/1998 | Usa | |
| 7,449,627 | B2 * | 11/2008 | Sako et al. | 84/612 |
| 7,659,472 | B2 | 2/2010 | Arimoto | |
| 7,668,610 | B1 | 2/2010 | Bennett | |
| 7,711,652 | B2 | 5/2010 | Schmelzer | |
| 7,777,121 | B2 | 8/2010 | Asano | |
| 7,797,249 | B2 | 9/2010 | Schmelzer et al. | |
| 7,863,512 | B2 | 1/2011 | Takeda | |
| 7,952,013 | B2 * | 5/2011 | Komori et al. | 84/636 |
| 8,005,666 | B2 | 8/2011 | Goto et al. | |
| 8,153,880 | B2 * | 4/2012 | Sasaki | 84/612 |
| 8,178,770 | B2 | 5/2012 | Kobayashi | |

(Continued)

FOREIGN PATENT DOCUMENTS

| | | | |
|---|---|---|---|
| EP | 1835503 | A2 | 9/2007 |
| JP | 2009265493 | A | 11/2009 |

OTHER PUBLICATIONS

Masataka Goto; "An Audio-based Real-time Beat Tracking System for Music With or Without Drum-sounds"; Journal of New Music Research, 2001, vol. 30, No. 2, pp. 159-171.

(Continued)

*Primary Examiner* — David Warren
(74) *Attorney, Agent, or Firm* — Rossi, Kimms & McDowell LLP

(57) ABSTRACT

A sound signal analysis apparatus 10 includes sound signal input portion for inputting a sound signal indicative of a musical piece, tempo detection portion for detecting a tempo of each of sections of the musical piece by use of the input sound signal, judgment portion for judging stability of the tempo, and control portion for controlling a certain target in accordance with a result judged by the judgment portion.

16 Claims, 23 Drawing Sheets

(56) References Cited

U.S. PATENT DOCUMENTS

| | | | | |
|---|---|---|---|---|
| 8,420,921 | B2 | 4/2013 | Kobayashi | |
| 8,437,869 | B1 | 5/2013 | Bennett | |
| 8,481,839 | B2 * | 7/2013 | Shaffer et al. | 84/610 |
| 8,484,691 | B2 | 7/2013 | Schmelzer | |
| 8,487,176 | B1 | 7/2013 | Wieder | |
| 8,595,009 | B2 | 11/2013 | Lu et al. | |
| 8,618,401 | B2 | 12/2013 | Kobayashi | |
| 8,645,279 | B2 | 2/2014 | Schmelzer | |
| 8,706,274 | B2 | 4/2014 | Kobayashi | |
| 8,829,322 | B2 | 9/2014 | Walmsley | |
| 8,873,813 | B2 | 10/2014 | Tadayon et al. | |
| 8,886,345 | B1 * | 11/2014 | Izo et al. | 700/94 |
| 2005/0081700 | A1 * | 4/2005 | Kikumoto | 84/604 |
| 2007/0157798 | A1 * | 7/2007 | Sako et al. | 84/611 |
| 2007/0169614 | A1 * | 7/2007 | Sasaki et al. | 84/612 |
| 2007/0221046 | A1 * | 9/2007 | Ozaki et al. | 84/612 |
| 2008/0053295 | A1 | 3/2008 | Goto et al. | |
| 2008/0097754 | A1 | 4/2008 | Goto et al. | |
| 2008/0202321 | A1 | 8/2008 | Goto et al. | |
| 2008/0245214 | A1 * | 10/2008 | Kikumoto | 84/604 |
| 2009/0025538 | A1 | 1/2009 | Arimoto | |
| 2009/0071315 | A1 | 3/2009 | Fortuna | |
| 2009/0163276 | A1 * | 6/2009 | Inubushi et al. | 463/36 |
| 2009/0288546 | A1 | 11/2009 | Takeda | |
| 2010/0011939 | A1 | 1/2010 | Nakadai et al. | |
| 2010/0077306 | A1 * | 3/2010 | Shaffer et al. | 715/716 |
| 2010/0126332 | A1 | 5/2010 | Kobayashi | |
| 2010/0170382 | A1 | 7/2010 | Kobayashi | |
| 2010/0186576 | A1 | 7/2010 | Kobayashi | |
| 2010/0211200 | A1 | 8/2010 | Kobayashi | |
| 2010/0246842 | A1 | 9/2010 | Kobayashi | |
| 2010/0251877 | A1 * | 10/2010 | Jochelson et al. | 84/609 |
| 2011/0112994 | A1 | 5/2011 | Goto et al. | |
| 2012/0031257 | A1 | 2/2012 | Saino | |
| 2012/0125179 | A1 | 5/2012 | Kobayashi | |
| 2013/0046536 | A1 | 2/2013 | Lu et al. | |
| 2013/0103624 | A1 | 4/2013 | Thieberger | |
| 2013/0192445 | A1 | 8/2013 | Sumi et al. | |
| 2013/0305904 | A1 | 11/2013 | Sumi | |
| 2014/0079297 | A1 | 3/2014 | Tadayon et al. | |
| 2014/0111418 | A1 | 4/2014 | Lee et al. | |
| 2014/0116233 | A1 | 5/2014 | Walmsley | |
| 2014/0121797 | A1 * | 5/2014 | Ales | 700/94 |
| 2014/0140536 | A1 | 5/2014 | Serletic, II et al. | |
| 2014/0174279 | A1 | 6/2014 | Wong et al. | |
| 2014/0180673 | A1 | 6/2014 | Neuhauser et al. | |
| 2014/0180674 | A1 | 6/2014 | Neuhauser et al. | |
| 2014/0180675 | A1 | 6/2014 | Neuhauser et al. | |
| 2014/0238220 | A1 | 8/2014 | Nakamura | |
| 2014/0260911 | A1 * | 9/2014 | Maezawa | 84/612 |
| 2014/0260912 | A1 | 9/2014 | Maezawa | |
| 2014/0297012 | A1 | 10/2014 | Kobayashi | |
| 2014/0358265 | A1 | 12/2014 | Wang et al. | |
| 2014/0366710 | A1 | 12/2014 | Eronen et al. | |
| 2015/0013527 | A1 | 1/2015 | Buskies et al. | |
| 2015/0013528 | A1 | 1/2015 | Buskies et al. | |

OTHER PUBLICATIONS

Davies, et al.; "Beat Tracking With a Two State Model", Queen Mary, University of London, Centre for Digital Music, Mile End Road, London E1 4NS, UK. (2 selected pages).

Oliveira, et al.; "IBT: A Real-Time Tempo and Beat Tracking System", 2010 International Society for Music Information Retrieval. (3 selected pages).

Fox et al: "Drum 'N' Bayes: On-Line Variational Inference for Beat Tracking and Rhythm Recognition", International Computer Music Conference Proceedings, Jan. 1, 2007, XP055125980. Retrieved on Jun. 30, 2014. Cited in EPSR issued in counterpart appln No. EP14157746.0, dated Jul. 25, 2014.

Klapuri et al: "Analysis of the Meter of Acoustic Musical Signals", IEEE Transactions on Audio, Speech, and Language Processing, Jan. 1, 2006, pp. 342-355, XP055125906. Cited in EPSR issued in counterpart appln No. EP14157746.0, dated Jul. 25, 2014.

European Search Report issued in European counterpart application No. EP14157746.0, dated Jul. 25, 2014.

Degara et al., "Reliability-Informed Beat Tracking of Musical Signals", IEEE Transactions on Audio, Speech and Language Processing, vol. 20, No. 1, Jan. 1, 2012, pp. 290-301. Cited in pending related U.S. Appl. No. 14/212,022.

Masataka Goto, et al.; "Songle: A Web Service for Active Music Listening Improved by User Contributions"; 12th International Society for Music Information Retrieval Conference, 2011, pp. 311-316. Cited in pending related U.S. Appl. No. 14/212,022.

Klapuri, Anssi P., et al.; "Analysis of the Meter of Acoustic Musical Signals"; IEEE Trans. Speech and Audio Proc. (in press), pp. 1-14, 2004. Cited in pending related U.S. Appl. No. 14/212,022.

Dixon, Simon, et al.; "Beat Tracking with Musical Knowledge". Cited in pending related U.S. Appl. No. 14/212,022.

Stark et al., "Real-Time Beat-Synchronous Analysis of Musical Audio", Proceedings of the 12th International Conference on Digital Audio Effects (DAFX-09), Como, Italy, Sep. 1-4, 2009. pp. 1-6. Cited in pending related U.S. Appl. No. 14/212,022.

Rodriguez-Serrano et al., "Amplitude Modulated Sinusoidal Modeling for Audio Onset Detection", 18th European Signal Processing Conference (EUSIPCO-2010), Aalborg, Denmark, Aug. 23-27, 2010, 5 pages. Cited in pending related U.S. Appl. No. 14/212,022.

European Search Report dated Jul. 28, 2014, issued in European Patent Application No. 14157744. Cited in pending related U.S. Appl. No. 14/212,022.

* cited by examiner

FIG.15

| XO(t) | 10 | 2 | 0.5 | 5 | 1 | 0 | 3 | 4 | 2 |
|---|---|---|---|---|---|---|---|---|---|
| $Log(P(XO(t_i) \mid Z_{6,0}(t_i)))$ | −11.04 | −0.62 | −1.76 | −1.27 | −1.27 | −2.35 | −0.40 | −0.62 | −0.62 |
| $Log(P(XO(t_i) \mid Z_{6,1}(t_i)))$ | −22.11 | −1.27 | −0.45 | −5.83 | −0.62 | −0.40 | −2.35 | −3.87 | −1.27 |
| $Log(P(XO(t_i) \mid Z_{6,2}(t_i)))$ | −22.11 | −1.27 | −0.45 | −5.83 | −0.62 | −0.40 | −2.35 | −3.87 | −1.27 |
| $Log(P(XO(t_i) \mid Z_{6,3}(t_i)))$ | −17.99 | −0.62 | −0.45 | −3.87 | −0.40 | −0.62 | −1.27 | −2.35 | −0.62 |
| $Log(P(XO(t_i) \mid Z_{6,4}(t_i)))$ | −22.11 | −1.27 | −0.45 | −5.83 | −0.62 | −0.40 | −2.35 | −3.87 | −1.27 |
| $Log(P(XO(t_i) \mid Z_{6,5}(t_i)))$ | −22.11 | −1.27 | −0.45 | −5.83 | −0.62 | −0.40 | −2.35 | −3.87 | −1.27 |

FIG.16

| | | | | | | | | | | | | $TP_\gamma$ |
|---|---|---|---|---|---|---|---|---|---|---|---|---|
| | ⋮ | | | | | | | | | | | |
| $TP_2$ | $\delta_{2,1}$ | $\delta_{2,2}$ | $\delta_{2,3}$ | $\delta_{2,4}$ | $\delta_{2,5}$ | $\delta_{2,6}$ | $\delta_{2,7}$ | $\delta_{2,8}$ | $\delta_{2,9}$ | $\delta_{2,10}$ | $\delta_{2,11}$ | $\delta_{2,12}$ |
| $TP_3$ | $\delta_{3,1}$ | $\delta_{3,2}$ | $\delta_{3,3}$ | $\delta_{3,4}$ | $\delta_{3,5}$ | $\delta_{3,6}$ | $\delta_{3,7}$ | $\delta_{3,8}$ | $\delta_{3,9}$ | $\delta_{3,10}$ | $\delta_{3,11}$ | $\delta_{3,12}$ |
| $TP_4$ | $\delta_{4,1}$ | $\delta_{4,2}$ | $\delta_{4,3}$ | $\delta_{4,4}$ | $\delta_{4,5}$ | $\delta_{4,6}$ | $\delta_{4,7}$ | $\delta_{4,18}$ | $\delta_{4,9}$ | $\delta_{4,10}$ | $\delta_{4,11}$ | $\delta_{4,12}$ |
| $TP_5$ | $\delta_{5,1}$ | $\delta_{5,2}$ | $\delta_{5,3}$ | $\delta_{5,4}$ | $\delta_{5,5}$ | $\delta_{5,6}$ | $\delta_{5,7}$ | $\delta_{5,8}$ | $\delta_{5,9}$ | $\delta_{5,10}$ | $\delta_{5,11}$ | $\delta_{5,12}$ |
| $TP_6$ | $\delta_{6,1}$ | $\delta_{6,2}$ | $\delta_{6,3}$ | $\delta_{6,4}$ | $\delta_{6,5}$ | $\delta_{6,6}$ | $\delta_{6,7}$ | $\delta_{6,8}$ | $\delta_{6,9}$ | $\delta_{6,10}$ | $\delta_{6,11}$ | $\delta_{6,12}$ |
| | ⋮ | | | | | | | | | | | |

| | |
|---|---|
| $Log(P(XB(t_i) \mid Z_{2,n}(t_i)))$ | 4.14425 |
| $Log(P(XB(t_i) \mid Z_{3,n}(t_i)))$ | 4.66149 |
| $Log(P(XB(t_i) \mid Z_{4,n}(t_i)))$ | 7.83838 |
| $Log(P(XB(t_i) \mid Z_{5,n}(t_i)))$ | 2.79372 |
| $Log(P(XB(t_i) \mid Z_{6,n}(t_i)))$ | 2.09529 |

FIG.19

L

| state | t0 | t1 | t2 | t3 | … | t37 | t38 | t39 | t40 | t41 | t42 | t43 | t44 | t45 | t46 | t47 | t48 | … | t74 | t75 | t76 | t77 |
|---|---|---|---|---|---|---|---|---|---|---|---|---|---|---|---|---|---|---|---|---|---|---|
| $q_{3,0}$ | 1.1 | 0.1 | 0.1 | 1.1 | | 0.1 | 1.1 | 0.3 | 0.1 | 0.1 | 0.1 | 1.1 | 0.3 | 0.1 | 0.1 | 0.1 | 1.1 | | 0.3 | 0.1 | 0.1 | 0.1 |
| $q_{3,1}$ | −1.1 | −0.1 | 0.0 | −1.1 | … | 0.0 | −1.1 | −0.3 | −0.1 | −0.1 | −0.1 | −1.1 | −0.3 | −0.1 | −0.1 | −0.1 | −1.1 | … | −0.3 | −0.1 | −0.1 | −0.1 |
| $q_{3,2}$ | −1.1 | −0.1 | 0.0 | −1.1 | | 0.0 | −1.1 | −0.3 | −0.1 | −0.1 | −0.1 | −1.1 | −0.3 | −0.1 | −0.1 | −0.1 | −1.1 | | −0.3 | −0.1 | −0.1 | −0.1 |
| $q_{4,0}$ | 1.1 | 0.1 | 0.1 | 1.1 | | 1.1 | 1.1 | 0.3 | 0.1 | 0.1 | 0.1 | 1.1 | 0.3 | 0.1 | 0.1 | 0.1 | 1.1 | | 0.3 | 0.1 | 0.1 | 0.1 |
| $q_{4,1}$ | −1.1 | −0.1 | −0.1 | −1.1 | … | −0.1 | −1.1 | −0.3 | −0.1 | −0.1 | −0.1 | −1.1 | −0.3 | −0.1 | −0.1 | −0.1 | −1.1 | … | −0.3 | −0.1 | −0.1 | −0.1 |
| $q_{4,2}$ | −1.1 | −0.1 | −0.1 | −1.1 | | −0.1 | −1.1 | −0.3 | −0.1 | −0.1 | −0.1 | −1.1 | −0.3 | −0.1 | −0.1 | −0.1 | −1.1 | | −0.3 | −0.1 | −0.1 | −0.1 |
| $q_{4,3}$ | −1.1 | −0.1 | −0.1 | −1.1 | | −0.1 | −1.1 | −0.3 | −0.1 | −0.1 | −0.1 | −1.1 | −0.3 | −0.1 | −0.1 | −0.1 | −1.1 | | −0.3 | −0.1 | −0.1 | −0.1 |
| $q_{5,0}$ | 1.1 | 0.1 | 0.1 | 1.1 | | 0.1 | 1.1 | 0.3 | 0.2 | 0.1 | 0.1 | 1.1 | 0.3 | 0.2 | 0.1 | 0.1 | 1.1 | | 0.3 | 0.2 | 0.1 | 0.1 |
| $q_{5,1}$ | −1.1 | −0.1 | −0.1 | −1.1 | | −0.1 | −1.1 | −0.2 | −0.1 | −0.1 | 0.0 | −1.1 | −0.2 | −0.1 | −0.1 | 0.0 | −1.1 | | −0.2 | −0.1 | −0.1 | 0.0 |
| $q_{5,2}$ | −1.1 | −0.1 | −0.1 | −1.1 | … | −0.1 | −1.1 | −0.2 | −0.1 | −0.1 | 0.0 | −1.1 | −0.2 | −0.1 | −0.1 | 0.0 | −1.1 | … | −0.2 | −0.1 | −0.1 | 0.0 |
| $q_{5,3}$ | −1.1 | −0.1 | −0.1 | −1.1 | | −0.1 | −1.1 | −0.2 | −0.1 | −0.1 | 0.0 | −1.1 | −0.2 | −0.1 | −0.1 | 0.0 | −1.1 | | −0.2 | −0.1 | −0.1 | 0.0 |
| $q_{5,4}$ | −1.1 | −0.1 | −0.1 | −1.1 | | −0.1 | −1.1 | −0.2 | −0.1 | −0.1 | 0.0 | −1.1 | −0.2 | −0.1 | −0.1 | 0.0 | −1.1 | | −0.2 | −0.1 | −0.1 | 0.0 |

FIG.20

C

| state | initial condition CS | t0 | t1 | t2 | t3 | … | t37 | t38 | t39 | t40 | t41 | t42 | t43 | t44 | t45 | t46 | t47 | t48 | … | t74 | t75 | t76 | t77 |
|---|---|---|---|---|---|---|---|---|---|---|---|---|---|---|---|---|---|---|---|---|---|---|---|
| $q_{3,0}$ | 0.0 | 1.1 | −0.9 | 0.0 | 2.0 | | 7.6 | 6.2 | 9.3 | 7.9 | 8.0 | 9.0 | 8.9 | 6.9 | 7.5 | 8.7 | 6.6 | 8.3 | | 7.4 | 9.2 | 8.9 | 7.1 |
| $q_{3,1}$ | 0.0 | −1.1 | −0.1 | 0.9 | −2.2 | … | 5.1 | 9.1 | 7.8 | 7.9 | 8.9 | 7.8 | 6.7 | 7.4 | 8.6 | 6.5 | 7.2 | 7.3 | … | 9.1 | 8.8 | 7.0 | 8.9 |
| $q_{3,2}$ | 1.0 | −0.1 | 0.9 | −1.1 | −1.3 | | 10.2 | 8.0 | 8.1 | 9.0 | 7.8 | 7.8 | 7.7 | 8.7 | 6.6 | 7.2 | 8.4 | 7.2 | | 9.0 | 7.1 | 8.9 | 8.8 |
| $q_{4,0}$ | 0.0 | 1.1 | −1.0 | −1.2 | 0.9 | | 9.7 | 8.9 | 4.6 | 8.5 | 8.2 | 8.3 | 9.6 | 7.3 | 6.7 | 7.0 | 8.9 | 8.0 | | 7.1 | 7.4 | 9.5 | 11.6 |
| $q_{4,1}$ | 0.0 | −1.1 | −1.2 | −0.3 | −0.4 | … | 7.8 | 4.3 | 8.4 | 8.1 | 8.2 | 8.5 | 7.1 | 6.6 | 6.9 | 8.9 | 6.9 | 5.7 | … | 7.3 | 9.4 | 11.6 | 6.6 |
| $q_{4,2}$ | 0.0 | −1.1 | −0.2 | 0.8 | −2.4 | | 5.4 | 8.7 | 8.2 | 8.3 | 8.5 | 8.2 | 6.8 | 7.0 | 9.0 | 6.9 | 6.8 | 6.9 | | 9.5 | 11.7 | 6.6 | 8.5 |
| $q_{4,3}$ | 1.0 | −0.1 | 0.8 | −1.3 | −1.7 | | 9.8 | 8.4 | 8.5 | 8.6 | 8.2 | 7.9 | 7.3 | 9.1 | 7.0 | 6.8 | 8.0 | 7.6 | | 11.8 | 6.7 | 8.5 | 9.2 |
| $q_{5,0}$ | 0.0 | 1.1 | −1.0 | −1.2 | −0.2 | | 2.9 | 6.0 | 6.6 | 3.9 | 3.8 | 7.8 | 9.1 | 5.5 | 6.8 | 6.3 | 6.4 | 9.8 | | 5.0 | 5.1 | 7.1 | 9.1 |
| $q_{5,1}$ | 0.0 | −1.1 | −1.2 | −1.3 | −1.4 | | 4.9 | 6.3 | 3.8 | 3.6 | 7.7 | 7.9 | 5.2 | 6.6 | 6.2 | 6.3 | 8.6 | 5.5 | | 4.9 | 6.9 | 9.0 | 12.1 |
| $q_{5,2}$ | 0.0 | −1.1 | −1.2 | −0.3 | −0.4 | … | 7.4 | 4.0 | 3.7 | 7.8 | 8.0 | 6.3 | 6.8 | 6.3 | 6.3 | 8.6 | 6.6 | 5.4 | … | 7.0 | 9.1 | 12.1 | 6.3 |
| $q_{5,3}$ | 0.0 | −1.1 | −0.2 | 0.8 | −2.4 | | 5.0 | 3.9 | 7.9 | 8.0 | 6.3 | 7.9 | 6.5 | 6.4 | 8.7 | 6.6 | 6.5 | 5.3 | | 9.2 | 12.2 | 6.3 | 6.8 |
| $q_{5,4}$ | 1.0 | −0.1 | 0.8 | −1.3 | −2.5 | | 5.0 | 8.1 | 8.1 | 6.4 | 7.9 | 7.5 | 6.6 | 8.8 | 6.6 | 6.5 | 6.4 | 7.3 | | 12.3 | 6.4 | 6.8 | 8.9 |

FIG.21

I

| state | t0 | t1 | t2 | t3 | ··· | t37 | t38 | t39 | t40 | t41 | t42 | t43 | t44 | t45 | t46 | t47 | t48 | ··· | t74 | t75 | t76 | t77 |
|---|---|---|---|---|---|---|---|---|---|---|---|---|---|---|---|---|---|---|---|---|---|---|
| $q_{3,0}$ | $q_{3,1}$ | $q_{3,1}$ | $q_{3,1}$ | $q_{3,1}$ | ··· | $q_{3,1}$ | $q_{3,1}$ | $q_{3,1}$ | $q_{3,1}$ | $q_{3,1}$ | $q_{3,1}$ | $q_{3,1}$ | $q_{3,1}$ | $q_{3,1}$ | $q_{3,1}$ | $q_{3,1}$ | $q_{3,1}$ | ··· | $q_{3,1}$ | $q_{3,1}$ | $q_{3,1}$ | $q_{3,1}$ |
| $q_{3,1}$ | $q_{3,2}$ | $q_{3,2}$ | $q_{3,2}$ | $q_{3,2}$ | | $q_{3,2}$ | $q_{3,2}$ | $q_{3,2}$ | $q_{3,2}$ | $q_{3,2}$ | $q_{3,2}$ | $q_{3,2}$ | $q_{3,2}$ | $q_{3,2}$ | $q_{3,2}$ | $q_{3,2}$ | $q_{3,2}$ | | $q_{3,2}$ | $q_{3,2}$ | $q_{3,2}$ | $q_{3,2}$ |
| $q_{3,2}$ | $q_{3,0}$ | $q_{3,0}$ | $q_{3,0}$ | $q_{3,0}$ | | $q_{3,0}$ | $q_{4,0}$ | $q_{4,0}$ | $q_{3,0}$ | $q_{4,0}$ | $q_{3,0}$ | $q_{3,0}$ | $q_{4,0}$ | $q_{3,0}$ | $q_{3,0}$ | $q_{3,0}$ | $q_{4,0}$ | | $q_{3,0}$ | $q_{3,0}$ | $q_{3,0}$ | $q_{4,0}$ |
| $q_{4,0}$ | $q_{4,1}$ | $q_{4,1}$ | $q_{4,1}$ | $q_{4,1}$ | ··· | $q_{4,1}$ | $q_{4,1}$ | $q_{4,1}$ | $q_{4,1}$ | $q_{4,1}$ | $q_{4,1}$ | $q_{4,1}$ | $q_{4,1}$ | $q_{4,1}$ | $q_{4,1}$ | $q_{4,1}$ | $q_{4,1}$ | ··· | $q_{4,1}$ | $q_{4,1}$ | $q_{4,1}$ | $q_{4,1}$ |
| $q_{4,1}$ | $q_{4,2}$ | $q_{4,2}$ | $q_{4,2}$ | $q_{4,2}$ | | $q_{4,2}$ | $q_{4,2}$ | $q_{4,2}$ | $q_{4,2}$ | $q_{4,2}$ | $q_{4,2}$ | $q_{4,2}$ | $q_{4,2}$ | $q_{4,2}$ | $q_{4,2}$ | $q_{4,2}$ | $q_{4,2}$ | | $q_{4,2}$ | $q_{4,2}$ | $q_{4,2}$ | $q_{4,2}$ |
| $q_{4,2}$ | $q_{4,3}$ | $q_{4,3}$ | $q_{4,3}$ | $q_{4,3}$ | | $q_{4,3}$ | $q_{4,3}$ | $q_{4,3}$ | $q_{4,3}$ | $q_{4,3}$ | $q_{4,3}$ | $q_{4,3}$ | $q_{4,3}$ | $q_{4,3}$ | $q_{4,3}$ | $q_{4,3}$ | $q_{4,3}$ | | $q_{4,3}$ | $q_{4,3}$ | $q_{4,3}$ | $q_{4,3}$ |
| $q_{4,3}$ | $q_{4,0}$ | $q_{4,0}$ | $q_{4,0}$ | $q_{3,0}$ | | $q_{3,0}$ | $q_{4,0}$ | $q_{4,0}$ | $q_{3,0}$ | $q_{4,0}$ | $q_{4,0}$ | $q_{3,0}$ | $q_{4,0}$ | $q_{4,0}$ | $q_{3,0}$ | $q_{3,0}$ | $q_{4,0}$ | | $q_{5,0}$ | $q_{4,0}$ | $q_{3,0}$ | $q_{4,0}$ |
| $q_{5,0}$ | $q_{5,1}$ | $q_{5,1}$ | $q_{5,1}$ | $q_{5,1}$ | ··· | $q_{5,1}$ | $q_{5,1}$ | $q_{5,1}$ | $q_{5,1}$ | $q_{5,1}$ | $q_{5,1}$ | $q_{5,1}$ | $q_{5,1}$ | $q_{5,1}$ | $q_{5,1}$ | $q_{5,1}$ | $q_{5,1}$ | ··· | $q_{5,1}$ | $q_{5,1}$ | $q_{5,1}$ | $q_{5,1}$ |
| $q_{5,1}$ | $q_{5,2}$ | $q_{5,2}$ | $q_{5,2}$ | $q_{5,2}$ | | $q_{5,2}$ | $q_{5,2}$ | $q_{5,2}$ | $q_{5,2}$ | $q_{5,2}$ | $q_{5,2}$ | $q_{5,2}$ | $q_{5,2}$ | $q_{5,2}$ | $q_{5,2}$ | $q_{5,2}$ | $q_{5,2}$ | | $q_{5,2}$ | $q_{5,2}$ | $q_{5,2}$ | $q_{5,2}$ |
| $q_{5,2}$ | $q_{5,3}$ | $q_{5,3}$ | $q_{5,3}$ | $q_{5,3}$ | | $q_{5,3}$ | $q_{5,3}$ | $q_{5,3}$ | $q_{5,3}$ | $q_{5,3}$ | $q_{5,3}$ | $q_{5,3}$ | $q_{5,3}$ | $q_{5,3}$ | $q_{5,3}$ | $q_{5,3}$ | $q_{5,3}$ | | $q_{5,3}$ | $q_{5,3}$ | $q_{5,3}$ | $q_{5,3}$ |
| $q_{5,3}$ | $q_{5,4}$ | $q_{5,4}$ | $q_{5,4}$ | $q_{5,4}$ | | $q_{5,4}$ | $q_{5,4}$ | $q_{5,4}$ | $q_{5,4}$ | $q_{5,4}$ | $q_{5,4}$ | $q_{5,4}$ | $q_{5,4}$ | $q_{5,4}$ | $q_{5,4}$ | $q_{5,4}$ | $q_{5,4}$ | | $q_{5,4}$ | $q_{5,4}$ | $q_{5,4}$ | $q_{5,4}$ |
| $q_{5,4}$ | $q_{5,0}$ | $q_{5,0}$ | $q_{5,0}$ | $q_{5,0}$ | | $q_{5,0}$ | $q_{4,0}$ | $q_{4,0}$ | $q_{5,0}$ | $q_{4,0}$ | $q_{4,0}$ | $q_{4,0}$ | $q_{4,0}$ | $q_{4,0}$ | $q_{5,0}$ | $q_{4,0}$ | $q_{4,0}$ | | $q_{5,0}$ | $q_{4,0}$ | $q_{4,0}$ | $q_{4,0}$ |

FIG.22

| | t0 | t1 | t2 | t3 | … | t37 | t38 | t39 | t40 | t41 | t42 | t43 | t44 | t45 | t46 | t47 | t48 | … | t74 | t75 | t76 | t77 |
|---|---|---|---|---|---|---|---|---|---|---|---|---|---|---|---|---|---|---|---|---|---|---|
| BPM-ness:b=3 | 0.32 | 0.32 | 0.34 | 0.60 | | 0.43 | 0.36 | 0.46 | 0.36 | 0.35 | 0.33 | 0.26 | 0.30 | 0.29 | 0.30 | 0.24 | 0.21 | | 0.05 | 0.05 | 0.05 | 0.04 |
| BPM-ness:b=4 | 0.33 | 0.36 | 0.30 | 0.23 | … | 0.54 | 0.57 | 0.39 | 0.48 | 0.48 | 0.42 | 0.46 | 0.53 | 0.41 | 0.40 | 0.47 | 0.20 | … | 0.84 | 0.38 | 0.38 | 0.38 |
| BPM-ness:b=5 | 0.35 | 0.35 | 0.34 | 0.15 | | 0.03 | 0.12 | 0.18 | 0.16 | 0.16 | 0.27 | 0.29 | 0.29 | 0.31 | 0.30 | 0.29 | 0.59 | | 0.57 | 0.57 | 0.57 | 0.58 |
| mean of BPM-ness | 4.0 | 4.0 | 4.0 | 3.5 | … | 3.6 | 3.8 | 3.7 | 3.8 | 3.9 | 3.9 | 4.0 | 4.0 | 4.0 | 4.0 | 4.0 | 4.4 | … | 4.4 | 4.5 | 4.5 | 4.5 |
| variance of BPM-ness | 0.7 | 0.6 | 0.7 | 0.6 | | 0.3 | 0.4 | 0.6 | 0.5 | 0.5 | 0.6 | 0.6 | 0.5 | 0.6 | 0.6 | 0.5 | 0.7 | | 0.3 | 0.4 | 0.3 | 0.3 |

SOUND SIGNAL ANALYSIS APPARATUS, SOUND SIGNAL ANALYSIS METHOD AND SOUND SIGNAL ANALYSIS PROGRAM

BACKGROUND OF THE INVENTION

1. Field of the Invention

The present invention relates to a sound signal analysis apparatus, a sound signal analysis method and a sound signal analysis program for analyzing sound signals indicative of a musical piece to detect beat positions (beat timing) and tempo of the musical piece to make a certain target controlled by the apparatus, method and program operate such that the target synchronizes with the detected beat positions and tempo.

2. Description of the Related Art

Conventionally, there is a sound signal analysis apparatus which detects tempo of a musical piece and makes a certain target controlled by the apparatus operate such that the target synchronizes with the detected beat positions and tempo, as described in "Journal of New Music Research", No. 2, Vol. 30, 2001, 159-171, for example.

SUMMARY OF THE INVENTION

The conventional sound signal analysis apparatus of the above-described document is designed to deal with musical pieces each having a roughly constant tempo. Therefore, in a case where the conventional sound signal analysis apparatus deals with a musical piece in which tempo changes drastically at some midpoint in the musical piece, the apparatus has difficulty in correctly detecting beat positions and tempo in a time period at which the tempo changes. As a result, the conventional sound signal analysis apparatus presents a problem that the target operates unnaturally at the time period at which the tempo changes.

The present invention was accomplished to solve the above-described problem, and an object thereof is to provide a sound signal analysis apparatus which detects beat positions and tempo of a musical piece, and makes a target controlled by the sound signal analysis apparatus operate such that the target synchronizes with the detected beat positions and tempo, the sound signal analysis apparatus preventing the target from operating unnaturally at a time period in which tempo changes. As for descriptions about respective constituent features of the present invention, furthermore, reference letters of corresponding components of embodiments described later are provided in parentheses to facilitate the understanding of the present invention. However, it should not be understood that the constituent features of the present invention are limited to the corresponding components indicated by the reference letters of the embodiment.

In order to achieve the above-described object, it is a feature of the present invention to provide a sound signal analysis apparatus including sound signal input portion (S13, S120) for inputting a sound signal indicative of a musical piece; tempo detection portion (S15, S180) for detecting a tempo of each of sections of the musical piece by use of the input sound signal; judgment portion (S17, S234) for judging stability of the tempo; and control portion (S18, S19, S235, S236) for controlling a certain target (EXT, 16) in accordance with a result judged by the judgment portion.

In this case, the judgment portion (S17) may judge that the tempo is stable if an amount of change in tempo between the sections falls within a predetermined range, while the judgment portion may judge that the tempo is unstable if the amount of change in tempo between the sections is outside the predetermined range.

In this case, furthermore, the control portion may make the target controlled by the sound signal analysis apparatus operate in a predetermined first mode (S18, S235) in the section where the tempo is stable, while the control portion may make the target operate in a predetermined second mode (S19, S236) in the section where the tempo is unstable.

The sound signal analysis apparatus configured as above judges tempo stability of a musical piece to control a target in accordance with the analyzed result. Therefore, the sound signal analysis apparatus can prevent a problem that the rhythm of the musical piece cannot synchronize with the action of the target in the sections where the tempo is unstable. As a result, the sound signal analysis apparatus can prevent unnatural action of the target.

It is another feature of the present invention that the tempo detection portion has feature value calculation portion (S165, S167) for calculating a first feature value (XO) indicative of a feature relating to existence of a beat and a second feature value (XB) indicative of a feature relating to tempo for each of the sections of the musical piece; and estimation portion (S170, S180) for concurrently estimating a beat position and a change in tempo in the musical piece by selecting, from among a plurality of probability models described as sequences of states ($q_{b,n}$) classified according to a combination of a physical quantity (n) relating to existence of a beat in each of the sections and a physical quantity (b) relating to tempo in each of the sections, a probability model whose sequence of observation likelihoods (L) each indicative of a probability of concurrent observation of the first feature value and the second feature value in the each section satisfies a certain criterion.

In this case, the estimation portion may concurrently estimate a beat position and a change in tempo in the musical piece by selecting a probability model of the most likely sequence of observation likelihoods from among the plurality of probability models.

In this case, the estimation portion may have first probability output portion for outputting, as a probability of observation of the first feature value, a probability calculated by assigning the first feature value as a probability variable of a probability distribution function defined according to the physical quantity relating to existence of beat.

In this case, as a probability of observation of the first feature value, the first probability output portion may output a probability calculated by assigning the first feature value as a probability variable of any one of (including but not limited to the any one of) normal distribution, gamma distribution and Poisson distribution defined according to the physical quantity relating to existence of beat.

In this case, the estimation portion may have second probability output portion for outputting, as a probability of observation of the second feature value, goodness of fit of the second feature value to a plurality of templates provided according to the physical quantity relating to tempo.

In this case, furthermore, the estimation portion may have second probability output portion for outputting, as a probability of observation of the second feature value, a probability calculated by assigning the second feature value as a probability variable of probability distribution function defined according to the physical quantity relating to tempo.

In this case, as a probability of observation of the second feature value, the second probability output portion may output a probability calculated by assigning the first feature value as a probability variable of any one of (including but not limited to the any one of) multinomial distribution, Dirichlet distribution, multidimensional normal distribution, and multidimensional Poisson distribution defined according to the physical quantity relating to existence of beat.

The sound signal analysis apparatus configured as above can select a probability model satisfying a certain criterion (a probability model such as the most likely probability model or a maximum a posteriori probability model) of a sequence of observation likelihoods calculated by use of the first feature values indicative of feature relating to existence of beat and the second feature values indicative of feature relating to tempo to concurrently (jointly) estimate beat positions and changes in tempo in a musical piece. Therefore, the sound signal analysis apparatus can enhance accuracy of estimation of tempo, compared with a case where beat positions of a musical piece are figured out by calculation to obtain tempo by use of the calculation result.

It is a further feature of the present invention that the judgment portion calculates likelihoods (C) of the respective states in the respective sections in accordance with the first feature value and the second feature value observed from the top of the musical piece to the respective sections, and judges stability of tempo in the respective sections in accordance with the distribution of likelihoods of the respective states in the respective sections.

If the variance of distribution of the likelihoods of the respective states in the sections is small, it can be assumed that the reliability of the value of the tempo is high to result in stable tempo. On the other hand, if the variance of distribution of the likelihoods of the respective states in the sections is great, it can be assumed that the reliability of the value of the tempo is low to result in unstable tempo. According to the present invention, since the target is controlled in accordance with distribution of the likelihoods of the states, the sound signal analysis apparatus can prevent a problem that the rhythm of a musical piece cannot synchronize with the action of the target when the tempo is unstable. As a result, the sound signal analysis apparatus can prevent unnatural action of the target.

Furthermore, the present invention can be embodied not only as the invention of the sound signal analysis apparatus, but also as an invention of a sound signal analysis method and an invention of a computer program applied to the apparatus.

BRIEF DESCRIPTION OF THE DRAWINGS

FIG. 15 is a chart indicative of calculated results of observation likelihood of onset feature value;

FIG. 16 is a chart indicative of a configuration of templates;

FIG. 19 is a chart indicative of calculated results of log observation likelihood;

FIG. 20 is a chart indicative of results of calculation of likelihoods of states selected as a sequence of the maximum likelihoods of the states of respective frames when the onset feature values and the BPM feature values are observed from the top frame;

FIG. 21 is a chart indicative of calculated results of states before transition;

FIG. 22 is a chart indicative of an example of calculated results of BPM-ness, mean of BPM-ness and variance of BPM-ness;

DESCRIPTION OF THE PREFERRED EMBODIMENT

First Embodiment

Figure 1:
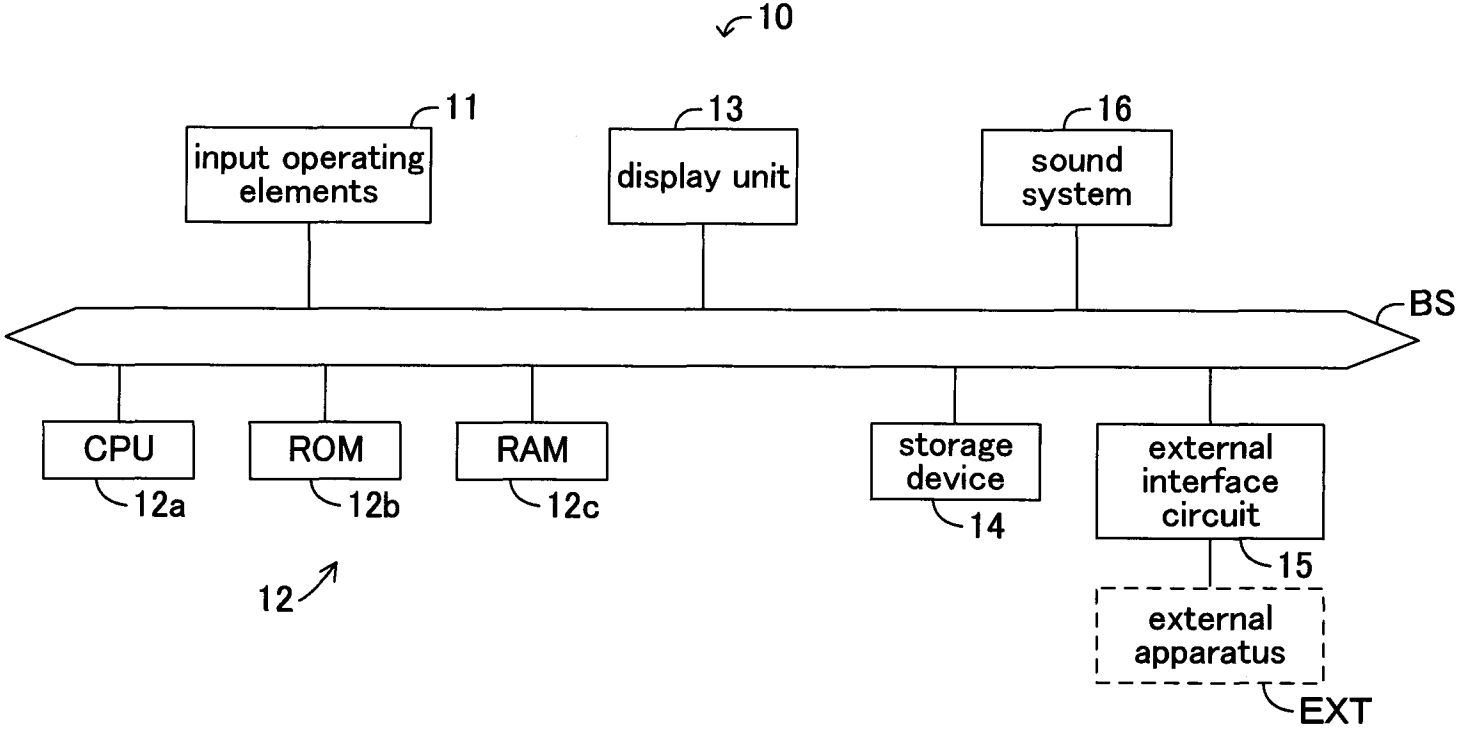
FIG. 1 is a block diagram indicative of an entire configuration of a sound signal analysis apparatus according to the first and second embodiments of the present invention.

A sound signal analysis apparatus 10 according to the first embodiment of the present invention will now be described. As described below, the sound signal analysis apparatus 10 receives sound signals indicative of a musical piece, detects tempo of the musical piece, and makes a certain target (an external apparatus EXT, an embedded musical performance apparatus or the like) controlled by the sound signal analysis apparatus 10 operate such that the target synchronizes with the detected tempo. As indicated in FIG. 1, the sound signal analysis apparatus 10 has input operating elements 11, a computer portion 12, a display unit 13, a storage device 14, an external interface circuit 15 and a sound system 16, with these components being connected with each other through a bus BS.

The input operating elements 11 are formed of switches capable of on/off operation (e.g., a numeric keypad for inputting numeric values), volumes or rotary encoders capable of rotary operation, volumes or linear encoders capable of sliding operation, a mouse, a touch panel and the like. These operating elements are manipulated with a player's hand to select a musical piece to analyze, to start or stop analysis of sound signals, to reproduce or stop the musical piece (to output or stop sound signals from the later-described sound system 16), or to set various kinds of parameters on analysis of sound signals. In response to the player's manipulation of the input operating elements 11, operational information indicative of the manipulation is supplied to the later-described computer portion 12 via the bus BS.

The computer portion 12 is formed of a CPU 12*a*, a ROM 12*b* and a RAM 12*c* which are connected to the bus BS. The CPU 12*a* reads out a sound signal analysis program and its subroutines which will be described in detail later from the ROM 12*b*, and executes the program and subroutines. In the ROM 12*b*, not only the sound signal analysis program and its subroutines but also initial setting parameters and various kinds of data such as graphic data and text data for generating display data indicative of images which are to be displayed on the display unit 13 are stored. In the RAM 12*c*, data necessary for execution of the sound signal analysis program is temporarily stored.

The display unit 13 is formed of a liquid crystal display (LCD). The computer portion 12 generates display data indicative of content which is to be displayed by use of graphic data, text data and the like, and supplies the generated display data to the display unit 13. The display unit 13 displays images on the basis of the display data supplied from the computer portion 12. At the time of selection of a musical piece to analyze, for example, a list of titles of musical pieces is displayed on the display unit 13.

The storage device 14 is formed of high-capacity nonvolatile storage media such as HDD, FDD, CD-ROM, MO and DVD, and their drive units. In the storage device 14, sets of musical piece data indicative of musical pieces, respectively, are stored. Each set of musical piece data is formed of a plurality of sample values obtained by sampling a musical piece at certain sampling periods ($1/44100$ s, for example), while the sample values are sequentially recorded in successive addresses of the storage device 14. Each set of musical piece data also includes title information representative of the title of the musical piece and data size information representative of the amount of the set of musical piece data. The sets of musical piece data may be previously stored in the storage device 14, or may be retrieved from an external apparatus via the external interface circuit 15 which will be described later. The musical piece data stored in the storage device 14 is read by the CPU 12*a* to analyze beat positions and changes in tempo in the musical piece.

The external interface circuit 15 has a connection terminal which enables the sound signal analysis apparatus 10 to connect with the external apparatus EXT such as an electronic musical apparatus, a personal computer, or a lighting apparatus. The sound signal analysis apparatus 10 can also connect to a communication network such as a LAN (Local Area Network) or the Internet via the external interface circuit 15.

The sound system 16 has a D/A converter for converting musical piece data to analog tone signals, an amplifier for amplifying the converted analog tone signals, and a pair of right and left speakers for converting the amplified analog tone signals to acoustic sound signals and outputting the acoustic sound signals. The sound system 16 also has an effect apparatus for adding effects (sound effects) to musical tones of a musical piece. The type of effects to be added to musical tones and the intensity of the effects are controlled by the CPU 12*a*.

Figure 2:
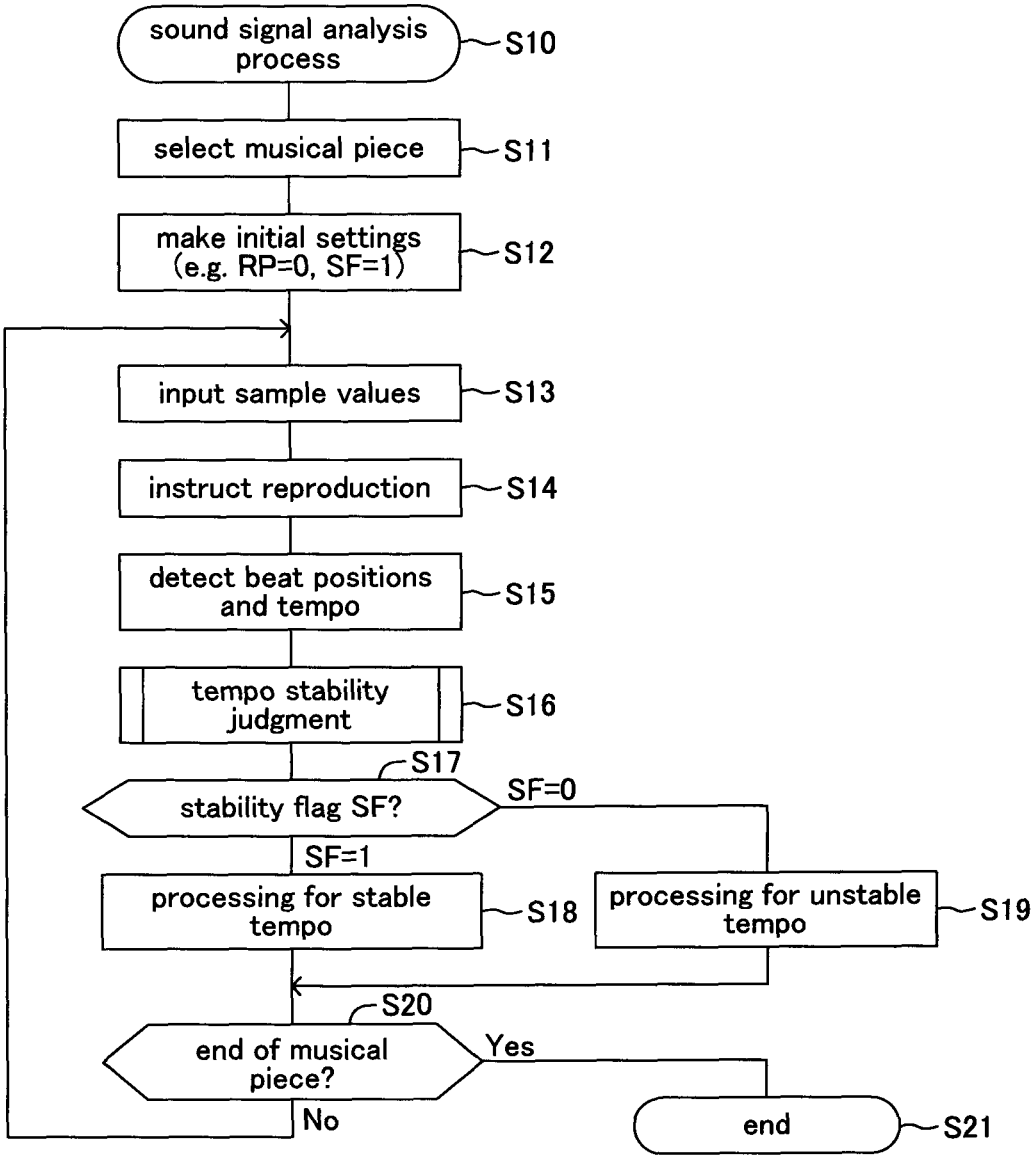
FIG. 2 is a flowchart of a sound signal analysis program according to the first embodiment of the invention.

Next, the operation in the first embodiment of the sound signal analysis apparatus 10 configured as above will be explained. When a user turns on a power switch (not shown) of the sound signal analysis apparatus 10, the CPU 12*a* reads out a sound signal analysis program indicated in FIG. 2 from the ROM 12*b*, and executes the program.

The CPU 12*a* starts a sound signal analysis process at step S10. At step S11, the CPU 12*a* reads title information included in sets of musical piece data stored in the storage device 14, and displays a list of titles of the musical pieces on the display unit 13. Using the input operating elements 11, the user selects a set of musical piece data which the user desires to analyze from among the musical pieces displayed on the display unit 13. The sound signal analysis process may be configured such that when the user selects a set of musical piece data which is to analyze at step S11, a part of or the entire of the musical piece represented by the set of musical piece data is reproduced so that the user can confirm the content of the musical piece data.

At step S12, the CPU 12*a* makes initial settings for sound signal analysis. In the RAM 12*c*, more specifically, the CPU 12*a* keeps a storage area for reading part of the musical piece data which is to analyze, and storage areas for a reading start pointer RP indicative of an address at which the reading of the musical piece data is started, tempo value buffers BF1 to BF4 for temporarily storing detected tempo values, and a stability flag SF indicative of stability of tempo (whether tempo has been changed or not). Then, the CPU 12*a* writes certain values into the kept storage areas as initial values, respectively. For example, the value of the reading start pointer RP is set at "0" indicative of the top of a musical piece. Furthermore, the value of the stability flag SF is set at "1" indicating that the tempo is stable.

At step S13, the CPU 12*a* reads a predetermined number (e.g., 256) of sample values consecutive in time series from the top address indicated by the reading start pointer RP into the RAM 12*c*, and advances the reading start pointer RP by the number of addresses equivalent to the number of read sample values. At step S14, the CPU 12*a* transmits the read sample values to the sound system 16. The sound system 16 converts the sample values received from the CPU 12*a* to analog signals in the order of time series at sampling periods, and amplifies the converted analog signals. The amplified signals are emitted from the speakers. As described later, a sequence of steps S13 to S20 is repeatedly executed. Each time step S13 is executed, as a result, the predetermined number of sample values are to be read from the top of the musical piece toward the end of the musical piece. More specifically, a section (hereafter referred to as a unit section) of the musical piece corresponding to the predetermined number of read sample values is reproduced at step S14. Consequently, the musical piece is to be smoothly reproduced from the top to the end of the musical piece.

Figure 3:
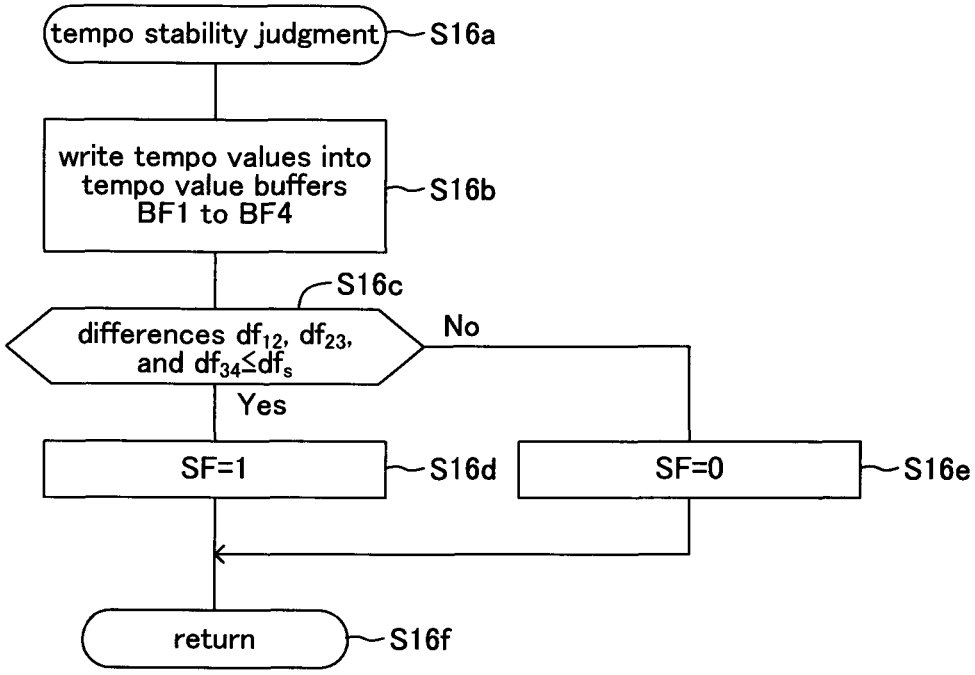
FIG. 3 is a flowchart of a tempo stability judgment program.

At step S15, the CPU 12*a* calculates beat positions and tempo (the number of beats per minute (BPM)) of the unit section formed of the predetermined number of read sample values or of a section including the unit section by calculation procedures similar to those described in the above-described "Journal of New Music Research". At step S16, the CPU 12*a* reads a tempo stability judgment program indicated in FIG. 3 from the ROM 12*b*, and executes the program. The tempo stability judgment program is a subroutine of the sound signal analysis program.

At step S16*a*, the CPU 12*a* starts a tempo stability judgment process. At step S16*b*, the CPU 12*a* writes values stored in the tempo value buffers BF2 to BF4, respectively, into the tempo value buffers BF1 to BF3, respectively, and writes a tempo value calculated at step S15 into the tempo value buffer BF4. As described later, since the steps S13 to S20 are repeatedly executed, tempo values of four consecutive unit sections are to be stored in the tempo value buffers BF1 to BF4, respectively. By use of the tempo values stored in the tempo value buffers BF1 to BF4, therefore, the stability of tempo of the consecutive four unit sections can be judged. Hereafter, the consecutive four unit sections are referred to as judgment sections.

At step S16*c*, the CPU 12*a* judges tempo stability of the judgment sections. More specifically, the CPU 12*a* calculates a difference $df_{12}$ ($=|BF1-BF2|$) between the value of the tempo value buffer BF1 and the value of the tempo value buffer BF2. Furthermore, the CPU 12*a* also calculates a difference $df_{23}$ (=|BF2−BF3|) between the value of the tempo value buffer BF2 and the value of the tempo value buffer BF3, and a difference $df_{34}$ (=|BF3−BF4|) between the value of the tempo value buffer BF3 and the value of the tempo value buffer BF4. The CPU 12*a* then judges whether the differences $df_{12}$, $df_{23}$, and $df_{34}$ are equal to or less than a predetermined reference value $df_s$ ($df_s$=4, for example). If each of the differences $df_{12}$, $df_{23}$, and $df_{34}$ is equal to or less than the reference value $df_s$, the CPU 12*a* determines "Yes" to proceed to step S16*d* to set the value of the stability flag SF at "1" which indicates that the tempo is stable. If at least one of the differences $df_{12}$, $df_{23}$, and $df_{34}$ is greater than the reference value $df_s$, the CPU 12*a* determines "No" to proceed to step S16*e* to set the value of the stability flag SF at "0" which indicates that the tempo is unstable (that is, the tempo drastically changes in the judgment sections. At step S16*f*, the CPU 12*a* terminates the tempo stability judgment process to proceed to step S17 of the sound signal analysis process (main routine).

The sound signal analysis process will now be explained again. At step S17, the CPU 12*a* determines a step which the CPU 12*a* executes next according to the tempo stability, that is, according to the value of the stability flag SF. If the stability flag SF is "1", the CPU 12*a* proceeds to step S18, in order to make the target operate in the first mode, to carry out certain processing required when the tempo is stable at step S18. For instance, the CPU 12*a* makes a lighting apparatus connected via the external interface circuit 15 blink at a tempo (hereafter referred to as a current tempo) calculated at step S15, or makes the lighting apparatus illuminate in different colors. In this case, for example, the lightness of the lighting apparatus is raised in synchronization with beat positions. Furthermore, the lighting apparatus may be kept lighting in a constant lightness and a constant color, for example. For instance, furthermore, an effect of a type corresponding to the current tempo may be added to musical tones currently reproduced by the sound system 16. In this case, for example, if an effect of delaying musical tones has been selected, the amount of delay may be set at a value corresponding to the current tempo. For instance, furthermore, a plurality of images may be displayed on the display unit 13, switching the images at the current tempo. For instance, furthermore, an electronic musical apparatus (electronic musical instrument) connected via the external interface circuit 15 may be controlled at the current tempo. In this case, for example, the CPU 12*a* analyzes chords of the judgment sections to transmit MIDI signals indicative of the chords to the electronic musical apparatus so that the electronic musical apparatus can emit musical tones corresponding to the chords. In this case, for example, a sequence of MIDI signals indicative of a phrase formed of musical tones of one or more musical instruments may be transmitted to the electronic musical apparatus at the current tempo. In this case, furthermore, the CPU 12*a* may synchronize the beat positions of the musical piece with the beat positions of the phrase. Consequently, the phrase can be played at the current tempo. For instance, furthermore, a phrase played by one or more musical instruments at a certain tempo may be sampled to store the sample values in the ROM 12*b*, the external storage device 15 or the like so that the CPU 12*a* can sequentially read out the sample values indicative of the phrase at a reading rate corresponding to the current tempo to transmit the read sample values to the sound system 16. As a result, the phrase can be reproduced at the current tempo.

If the stability flag SF is "0", the CPU 12*a* proceeds to step S19, in order to make the target operate in the second mode, to carry out certain processing required when the tempo is unstable at step S19. For instance, the CPU 12*a* stops the lighting apparatus connected via the external interface circuit 15 from blinking, or stops the lighting apparatus from varying colors. In a case where the lighting apparatus is controlled such that the lighting apparatus illuminates in a constant lightness and a constant color when the tempo is stable, the CPU 12*a* may control the lighting apparatus such that the lighting apparatus blinks or changes colors when the tempo is unstable. For instance, furthermore, the CPU 12*a* may define an effect added immediately before the tempo becomes unstable as an effect to be added to musical tones currently reproduced by the sound system 16. For instance, furthermore, the switching among the plurality of images may be stopped. In this case, a predetermined image (an image indicative of unstable tempo, for example) may be displayed. For instance, furthermore, the CPU 12*a* may stop transmission of MIDI signals to the electronic musical apparatus to stop accompaniment by the electronic musical apparatus. For instance, furthermore, the CPU 12*a* may stop reproduction of the phrase by the sound system 16.

At step S20, the CPU 12*a* judges whether or not the reading pointer RP has reached the end of the musical piece. If the reading pointer RP has not reached the end of the musical piece yet, the CPU 12*a* determines "No" to proceed to step S13 to carry out the sequence of steps S13 to S20 again. If the reading pointer RP has reached the end of the musical piece, the CPU 12*a* determines "Yes" to proceed to step S21 to terminate the sound signal analysis process.

According to the first embodiment, the sound signal analysis apparatus 10 judges tempo stability of the judgment sections to control the target such as the external apparatus EXT and the sound system 16 in accordance with the analyzed result. Therefore, the sound signal analysis apparatus 10 can prevent a problem that the rhythm of the musical piece cannot synchronize with the action of the target if the tempo is unstable in the judgment sections. As a result, the sound signal analysis apparatus 10 can prevent unnatural action of the target controlled by the sound signal analysis apparatus 10. Furthermore, since the sound signal analysis apparatus 10 can detect beat positions and tempo of a certain section of a musical piece during reproduction of the section of the musical piece, the sound signal analysis apparatus 10 is able to reproduce the musical piece immediately after the user's selection of the musical piece.

Second Embodiment

Next, the second embodiment of the present invention will be explained. Since a sound signal analysis apparatus according to the second embodiment is configured similarly to the sound signal analysis apparatus 10, the explanation about the configuration of the sound signal analysis apparatus of the second embodiment will be omitted. However, the sound signal analysis apparatus of the second embodiment operates differently from the first embodiment. In the second embodiment, more specifically, programs which are different from those of the first embodiment are executed. In the first embodiment, the sequence of steps (steps S13 to S20) in which the tempo stability of the judgment sections is analyzed to control the external apparatus EXT and the sound system 16 in accordance with the analyzed result during reading and reproduction of sample values of a section of a musical piece is repeated. In the second embodiment, however, all the sample values which form a musical piece are read to analyze beat positions and changes in tempo of the musical piece. After the analysis, furthermore, the reproduction of the musical piece is started, and the external apparatus EXT or the sound system 16 is controlled in accordance with the analyzed result.

Figure 4:
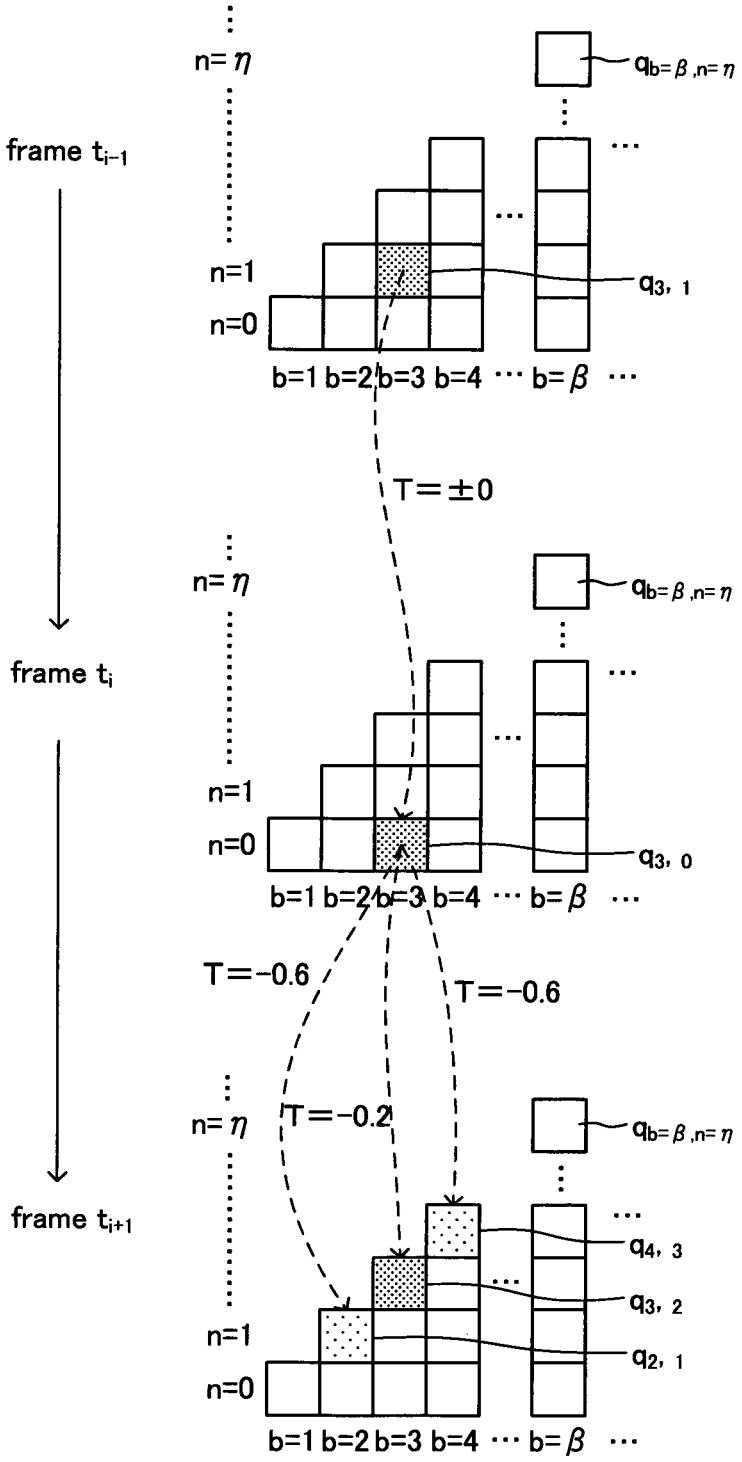
FIG. 4 is a conceptual illustration of a probability model.

Next, the operation of the sound signal analysis apparatus 10 in the second embodiment will be explained. First, the operation of the sound signal analysis apparatus 10 will be briefly explained. The musical piece which is to analyze is separated into a plurality of frames $t_i\{i=0, 1, \ldots, last\}$. For each frame $t_i$, furthermore, onset feature values XO representative of feature relating to existence of beat and BPM feature values XB representative of feature relating to tempo are calculated. From among probability models (Hidden Markov Models) described as sequences of states $q_{b,\ n}$ classified according to combination of a value of beat period b (value proportional to reciprocal of tempo) in a frame $t_i$ and a value of the number n of frames between the next beat, a probability model having the most likely sequence of observation likelihoods representative of probability of concurrent observation of the onset feature value XO and BPM feature value XB as observed values is selected (see FIG. 4). As a result, beat positions and changes in tempo of the musical piece subjected to analysis are detected. The beat period b is represented by the number of frames. Therefore, a value of the beat period b is an integer which satisfies "$1 \le b \le b_{max}$", while in a state where a value of the beat period b is "β", a value of the number n of frames is an integer which satisfies "$0 \le n < \beta$". Furthermore, the "BPM-ness" indicative of a probability that the value of the beat period b in frame $t_i$ is "β" ($1 \le n < b_{max}$) is calculated to calculate "variance of BPM-ness" by use of the "BPM-ness". On the basis of the "variance of BPM-ness", furthermore, the external apparatus EXT, the sound system 16 and the like are controlled.

Figure 5:
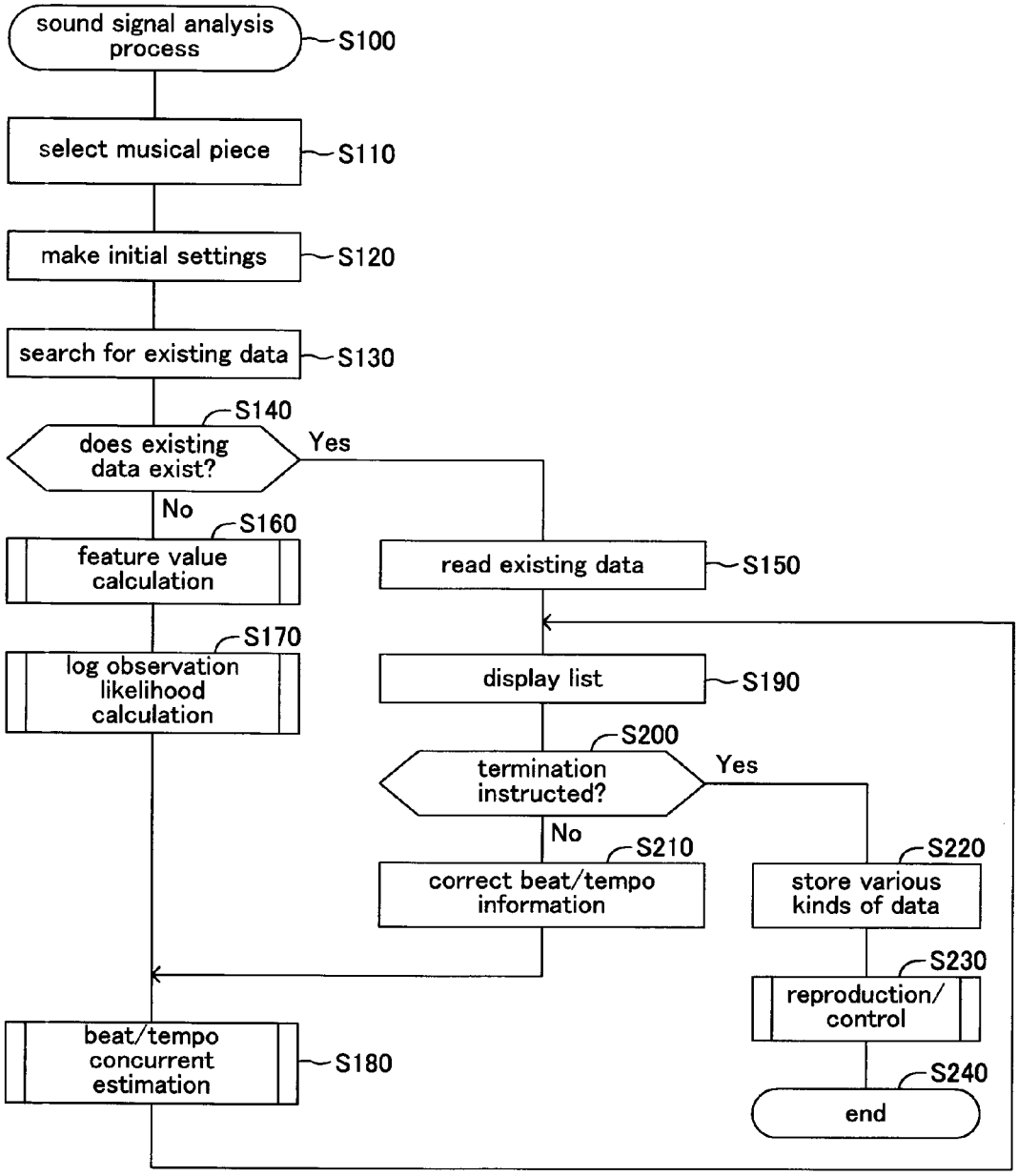
FIG. 5 is a flowchart of a sound signal analysis program according to the second embodiment of the invention.

Next, the operation of the sound signal analysis apparatus 10 in the second embodiment will be explained concretely. When the user turns on a power switch (not shown) of the sound signal analysis apparatus 10, the CPU 12*a* reads out a sound signal analysis program of FIG. 5 from the ROM 12*b*, and executes the program.

The CPU 12*a* starts a sound signal analysis process at step S100. At step S110, the CPU 12*a* reads title information included in the sets of musical piece data stored in the storage device 14, and displays a list of titles of the musical pieces on the display unit 13. Using the input operating elements 11, the user selects a set of musical piece data which the user desires to analyze from among the musical pieces displayed on the display unit 13. The sound signal analysis process may be configured such that when the user selects a set of musical piece data which is to analyze at step S110, a part of or the entire of the musical piece represented by the set of musical piece data is reproduced so that the user can confirm the content of the musical piece data.

At step S120, the CPU 12*a* makes initial settings for sound signal analysis. More specifically, the CPU 12*a* keeps a storage area appropriate to data size information of the selected set of musical piece data in the RAM 12*c*, and reads the selected set of musical piece data into the kept storage area. Furthermore, the CPU 12*a* keeps an area for temporarily storing a beat/tempo information list, the onset feature values XO, the BPM feature values XB and the like indicative of analyzed results in the RAM 12*c*.

The results analyzed by the program are to be stored in the storage device 14, which will be described in detail later (step S220). If the selected musical piece has been already analyzed by this program, the analyzed results are stored in the storage device 14. At step S130, therefore, the CPU 12*a* searches for existing data on the analysis of the selected musical piece (hereafter, simply referred to as existing data). If there is existing data, the CPU 12*a* determines "Yes" at step S140 to read the existing data into the RAM 12*c* at step S150 to proceed to step S190 which will be described later. If there is no existing data, the CPU 12*a* determines "No" at step S140 to proceed to step S160.

Figure 6:
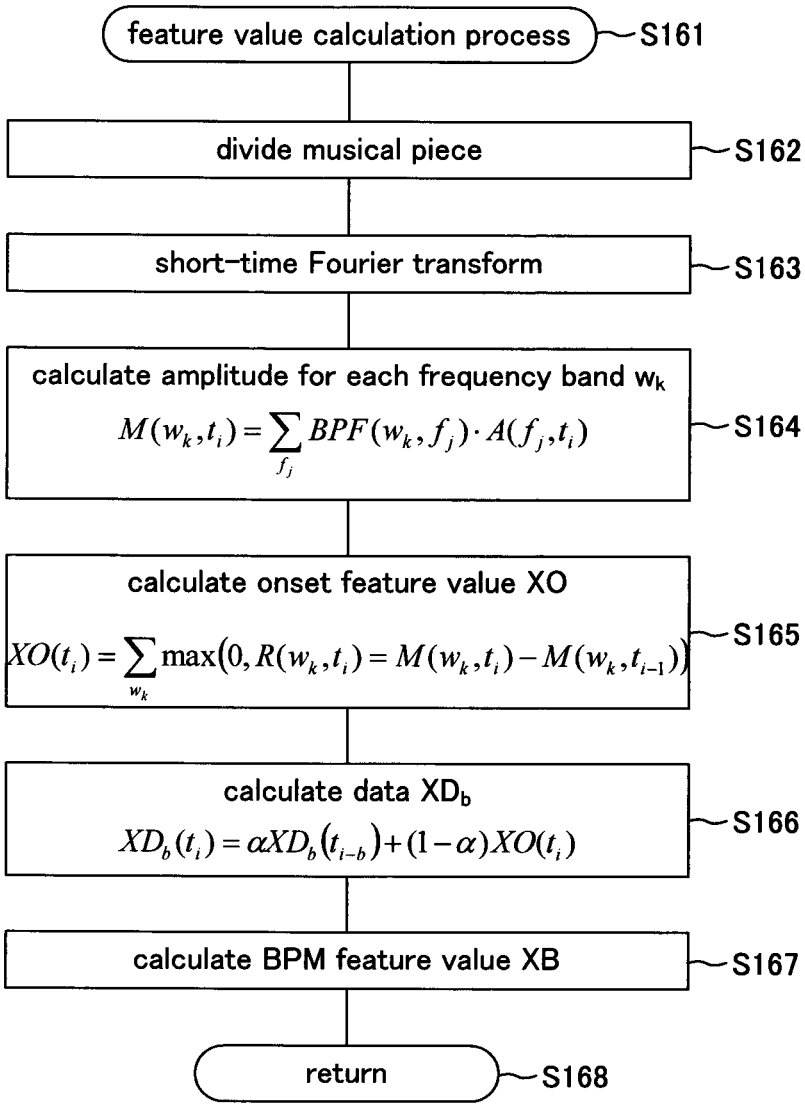
FIG. 6 is a flowchart of a feature value calculation program.

At step S160, the CPU 12*a* reads out a feature value calculation program indicated in FIG. 6 from the ROM 12*b*, and executes the program. The feature value calculation program is a subroutine of the sound signal analysis program.

Figure 7:
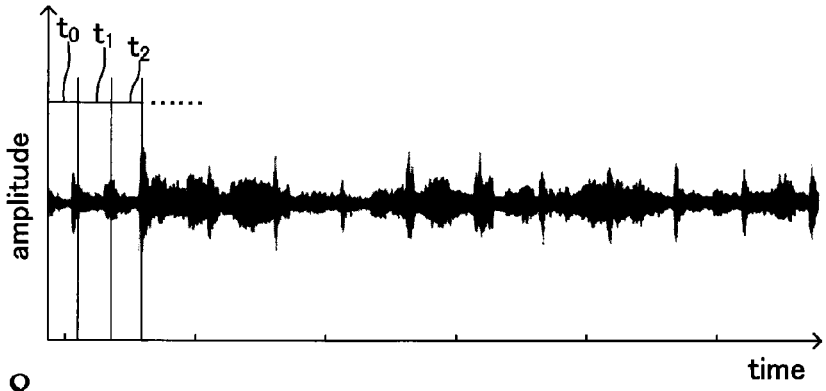
FIG. 7 is a graph indicative of a waveform of a sound signal to analyze.
Figure 8:
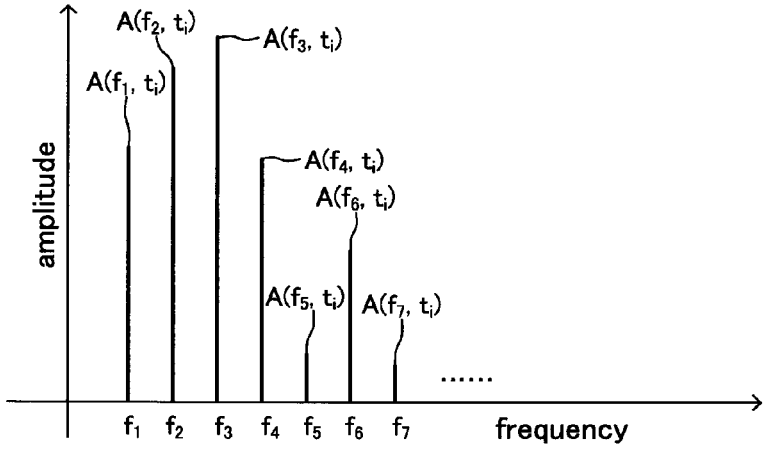
FIG. 8 is a diagram indicative of sound spectrum obtained by short-time Fourier transforming one frame.

At step S161, the CPU 12*a* starts a feature value calculation process. At step S162, the CPU 12*a* divides the selected musical piece at certain time intervals as indicated in FIG. 7 to separate the selected musical piece into a plurality of frames $t_i\{i=0, 1, \ldots, last\}$. The respective frames have the same length. For easy understanding, assume that each frame has 125 ms in this embodiment. Since the sampling period of each musical piece is $1/44100$ s as described above, each frame is formed of approximately 5000 sample values. As explained below, furthermore, the onset feature value XO and the BPM (beats per minute) feature value XB are calculated for each frame.

Figure 9:
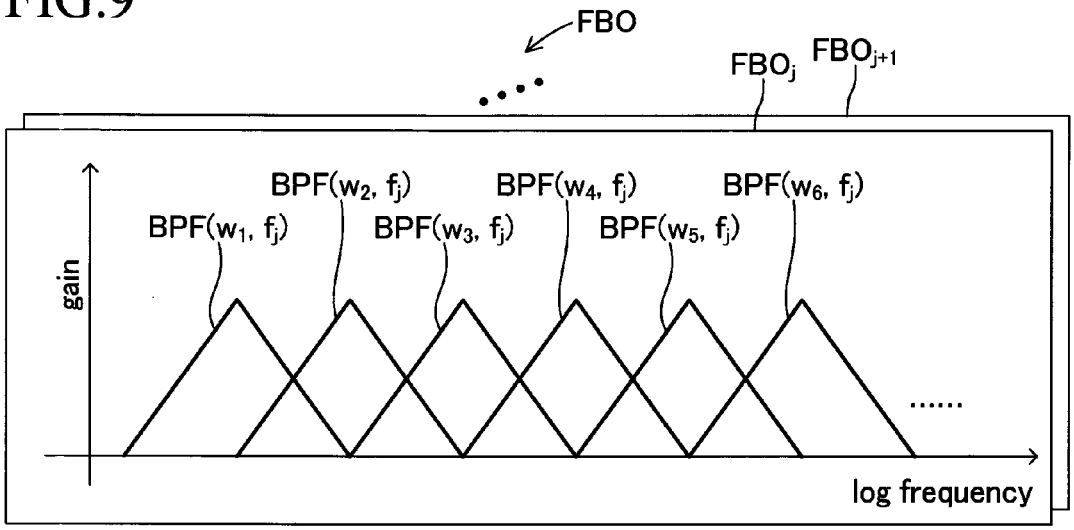
FIG. 9 is a diagram indicative of characteristics of band pass filters.
Figure 10:
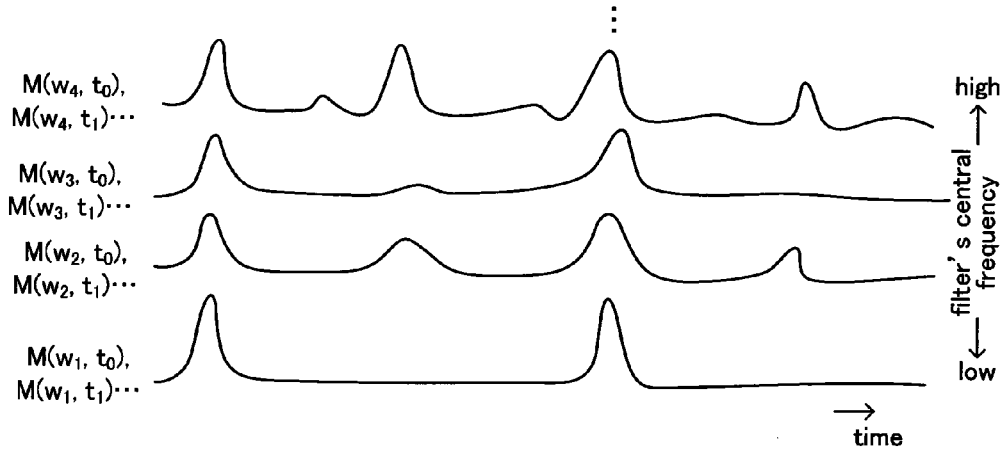
FIG. 10 is a graph indicative of time-variable amplitudes of respective frequency bands.

At step S163, the CPU 12*a* performs a short-time Fourier transform for each frame to figure out an amplitude $A(f_j, t_i)$ of each frequency bin $f_j$ $\{j=1, 2, \ldots\}$ as indicated in FIG. 6. At step S164, the CPU 12*a* filters the amplitudes $A(f_1, t_1)$, $A(f_2, t_i)$ . . . by filter banks $FBO_j$ provided for frequency bins $f_j$, respectively, to figure out amplitudes $M(w_k, t_i)$ of certain frequency bands $w_k$ $\{k=1, 2, \ldots\}$, respectively. The filter bank $FBO_j$ for the frequency bin $f_j$ is formed of a plurality of band path filters $BPF(w_k, f_j)$ each having a different central frequency of passband as indicated in FIG. 9. The central frequencies of the band pass filters $BPF(w_k, f_j)$ which form the filter band $FBO_j$ are spaced evenly on a log frequency scale, while the band pass filters $BPF(w_k, f_j)$ have the same passband width on the log frequency scale. Each bandpass filter $BPF(w_k, f_j)$ is configured such that the gain gradually decreases from the central frequency of the passband toward the lower limit frequency side and the upper limit frequency side of the passband. As indicated in step S164 of FIG. 6, the CPU 12*a* multiplies the amplitude $A(f_1, t_i)$ by the gain of the bandpass filter $BPF(w_k, f_j)$ for each frequency bin $f_j$. Then, the CPU 12*a* combines the summed results calculated for the respective frequency bins $f_j$. The combined result is referred to as an amplitude $M(w_k, t_i)$. An example sequence of the amplitudes M calculated as above is indicated in FIG. 10.

Figure 11:
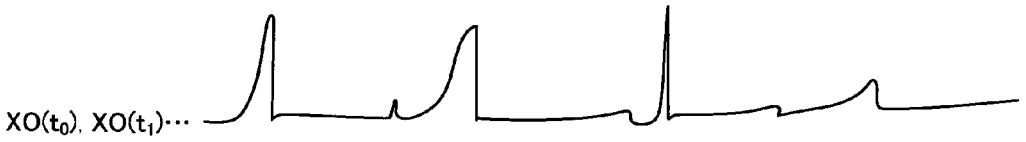
FIG. 11 is a graph indicative of time-variable onset feature value.

At step S165, the CPU 12*a* calculates the onset feature value $XO(t_i)$ of frame $t_i$ on the basis of the time-varying amplitudes M. As indicated in step S165 of FIG. 6, more specifically, the CPU 12*a* figures out an increased amount $R(w_k, t_i)$ of the amplitude M from frame $t_{i-1}$ to frame $t_i$ for each frequency band $w_k$. However, in a case where the amplitude $M(w_k, t_{i-1})$ of frame $t_{i-1}$ is identical with the amplitude $M(w_k, t_i)$ of frame $t_i$, or in a case where the amplitude $M(w_k, t_1)$ of frame $t_i$ is smaller than the amplitude $M(w_k, t_{i-1})$ of frame the increased amount $R(w_k, t_i)$ is assumed to be "0". Then, the CPU 12*a* combines the increased amounts $R(w_k, t_i)$ calculated for the respective frequency bands $w_1, w_2, \ldots$. The combined result is referred to as the onset feature value $XO(t_i)$. A sequence of the above-calculated onset feature values XO is exemplified in FIG. 11. In musical pieces, generally, beat positions have a large tone volume. Therefore, the greater the onset feature value $XO(t_i)$ is, the higher the possibility that the frame $t_i$ has a beat is.

Figure 12:
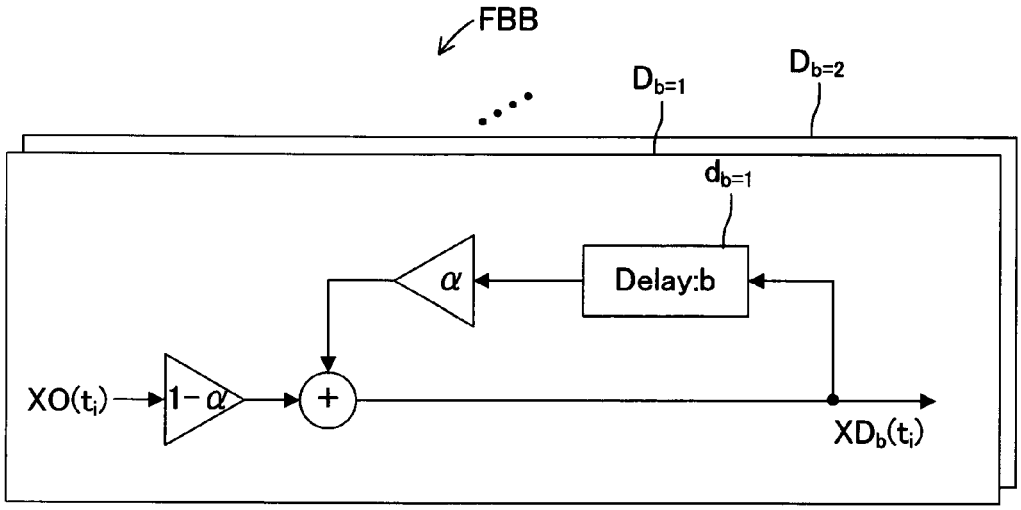
FIG. 12 is a block diagram of comb filters.

By use of the onset feature values $XO(t_0), XO(t_1), \ldots$, the CPU 12*a* then calculates the BPM feature value XB for each frame $t_i$. The BPM feature value $XB(t_i)$ of frame $t_i$ is represented as a set of BPM feature values $XB_{b=1,\ 2,\ \ldots}(t_i)$ calculated in each beat period b (see FIG. 13). At step S166, the CPU 12*a* inputs the onset feature values XO ($t_0$), X($t_1$), . . . in this order to a filter bank FBB to filter the onset feature values XO. The filter bank FBB is formed of a plurality of comb filters $D_b$ provided to correspond to the beat periods b, respectively. When the onset feature value XO($t_i$) of frame $t_i$ is input to the comb filter $D_{b=\beta}$, the comb filter $D_{b=\beta}$ combines the input onset feature value XO($t_i$) with data $XD_{b=\beta}$ ($t_{i-\beta}$) which is the output for the onset feature value XO($t_{i-\beta}$) of frame $t_{i-\beta}$ which precedes the frame $t_i$ by "β" at a certain proportion, and outputs the combined result as data $XD_{b=\beta}(t_i)$ of frame $t_i$ (see FIG. 12). In other words, the comb filter $D_{b=\beta}$ has a delay circuit $d_{b=\beta}$ which serves as holding portion for holding data $XD_{b=\beta}$, for a time period equivalent to the number of frames β. As described above, by inputting the sequence XO(t){=XO($t_0$), XO($t_1$), . . . } of the onset feature values XO to the filter bank FBB, the sequence $XD_b$ (t){=$XD_b$($t_0$), $XD_b$($t_1$), . . . } of data $XD_b$ can be figured out.

At step S167, the CPU 12*a* obtains the sequence $XB_b$(t){=$XB_b$($t_0$), $XB_b$($t_1$), . . . } of the BPM feature values by inputting a data sequence obtained by reversing the sequence $XD_b$(t) of data $XD_b$ in time series to the filter bank FBB. As a result, the phase shift between the phase of the onset feature values XO($t_0$), ($t_1$), . . . and the phase of the BPM feature values $XB_b$($t_0$), $XB_b$($t_1$), . . . can be made "0". The BPM feature values XB($t_i$) calculated as above are exemplified in FIG. 13. As described above, the BPM feature value $XB_b$($t_i$) is obtained by combining the onset feature value XO($t_i$) with the BPM feature value $XB_b$($t_{i-b}$) delayed for the time period (i.e., the number b of frames) equivalent to the value of the beat period b at the certain proportion. In a case where the onset feature values XO($t_0$), ($t_1$), . . . have peaks with time intervals equivalent to the value of the beat period b, therefore, the value of the BPM feature amount $XB_b$($t_i$) increases. Since the tempo of a musical piece is represented by the number of beats per minute, the beat period b is proportional to the reciprocal of the number of beats per minute. In the example shown in FIG. 13, for example, among the BPM feature values $XB_b$, the BPM feature value $XB_b$ with the value of the beat period b being "4" is the largest (BPM feature value $XB_{b=4}$). In this example, therefore, there is a high possibility that a beat exists every four frames. Since this embodiment is designed to define the length of each frame as 125 ms, the interval between the beats is 0.5 s in this case. In other words, the tempo is 120 BPM (=60 s/0.5 s).

At step S168, the CPU 12*a* terminates the feature value calculation process to proceed to step S170 of the sound signal analysis process (main routine).

Figure 14:
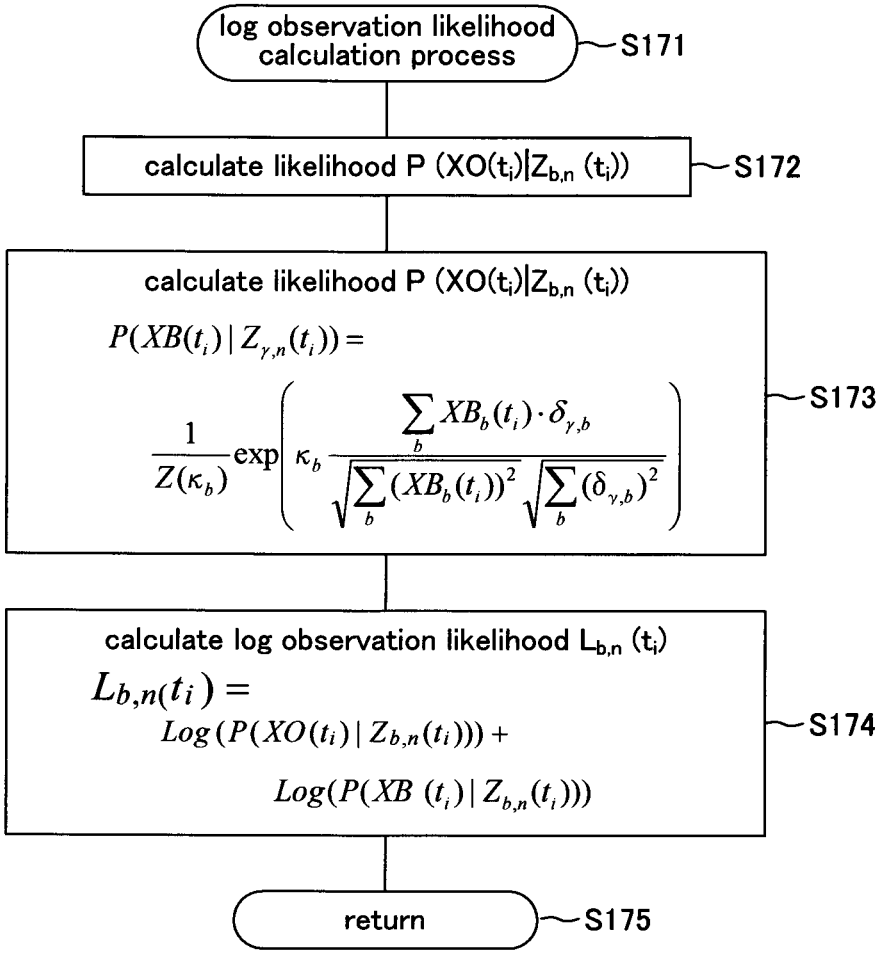
FIG. 14 is a flowchart of a log observation likelihood calculation program.

At step S170, the CPU 12*a* reads out a log observation likelihood calculation program indicated in FIG. 14 from the ROM 12*b*, and executes the program. The log observation likelihood calculation program is a subroutine of the sound signal analysis process.

At step S171, the CPU 12*a* starts the log observation likelihood calculation process. Then, as explained below, a likelihood P (XO($t_i$)|$Z_{b,n}$($t_i$)) of the onset feature value XO($t_i$) and a likelihood P (XB($t_i$)|$Z_{b,n}$($t_i$)) of the BPM feature value XB($t_i$) are calculated. The above-described "$Z_{b=\beta,n=\eta}$ ($t_1$)" represents the occurrence only of a state $q_{b=\beta,n=\eta}$ where the value of the beat period b is "β" in frame $t_i$, with the value of the number n of frames between the next beat being "η". In frame $t_i$, more specifically, the state $q_{b=\beta,n=\eta}$ and a state $q_{b=\beta,n=\eta}$ cannot occur concurrently. Therefore, the likelihood P (XO($t_i$)|$Z_{b=\beta,n=\eta}$ ($t_i$)) represents the probability of observation of the onset feature value XO($t_i$) on condition that the value of the beat period b is "β" in frame $t_i$, with the value of the number n of frames between the next beat being "η". Furthermore, the likelihood P (XB($t_i$)|$Z_{b=\beta,n=\eta}$ ($t_i$)) represents the probability of observation of the BPM feature value XB($t_i$) on condition that the value of the beat period b is "β" in frame $t_i$, with the value of the number n of frames between the next beat being "η".

At step S172, the CPU 12*a* calculates the likelihood P (XO($t_i$)|$Z_{b,n}$($t_i$)). Assume that if the value of the number n of frames between the next beat is "0", the onset feature values XO are distributed in accordance with the first normal distribution with a mean value of "3" and a variance of "1". In other words, the value obtained by assigning the onset feature value XO($t_i$) as a random variable of the first normal distribution is the likelihood P (XO($t_i$)|$Z_{b,n=0}$ ($t_i$)). Furthermore, assume that if the value of the beat period b is "β", with the value of the number n of frames between the next beat being "β/2", the onset feature values XO are distributed in accordance with the second normal distribution with a mean value of "1" and a variance of "1". In other words, the value obtained by assigning the onset feature value XO($t_i$) as a random variable of the second normal distribution is the likelihood P (XO($t_i$)| $Z_{b=\beta 3,n=\beta/2}$ ($t_i$)). Furthermore, assume that if the value of the number n of frames between the next beat is neither "0" nor "β/2", the onset feature values XO are distributed in accordance with the third normal distribution with a mean value of "0" and a variance of "1". In other words, the value obtained by assigning the onset feature value XO($t_i$) as a random variable of the third normal distribution is the likelihood P (XO($t_i$|$Z_{b,n\neq 0,\beta/2}$ ($t_i$)).

FIG. 15 indicates example results of log calculation of the likelihood P (XO($t_i$)|$Z_{b=6,n}$ ($t_1$)) with a sequence of onset feature values XO of {10, 2, 0.5, 5, 1, 0, 3, 4, 2}. As indicated in FIG. 15, the greater onset feature value XO the frame $t_i$ has, the greater the likelihood P (XO($t_i$)|$Z_{b,n=0}$ ($t_i$)) is, compared with the likelihood P (XO($t_i$)|$Z_{b,n\neq 0}$ ($t_i$)). As described above, the probability models (the first to third normal distributions and their parameters (mean value and variance)) are set such that the greater onset feature value XO the frame $t_i$ has, the higher the probability of existence of beat with the value of the number n of frames of "0" is. The parameter values of the first to third normal distributions are not limited to those of the above-described embodiment. These parameter values may be determined on the basis of repeated experiments, or by machine learning. In this example, normal distribution is used as probability distribution function for calculating the likelihood P of the onset feature value XO. However, a different function (e.g., gamma distribution or Poisson distribution) may be used as probability distribution function.

At step S173, the CPU 12*a* calculates the likelihood P (XB($t_i$)|$Z_{b,n}$($t_i$)). The likelihood P (XB($t_i$)|$Z_{b=\gamma,n}$ ($t_i$)) is equivalent to goodness of fit of the BPM feature value XB($t_i$) with respect to template $TP_\gamma$ {γ=1, 2, . . . } indicated in FIG. 16. More specifically, the likelihood P (XB($t_i$)|$Z_{b=\gamma,n}$ ($t_i$)) is equivalent to an inner product between the BPM feature value XB($t_i$) and the template $TP_\gamma$ {γ=1, 2, . . . } (see an expression of step S173 of FIG. 14). In this expression, "$\kappa_b$" is a factor which defines weight of the BPM feature value XB with respect to the onset feature value XO. In other words, the greater the $\kappa_b$ is, the more the BPM feature value XB is valued in a later-described beat/tempo concurrent estimation process as a result. In this expression, furthermore, "Z ($\kappa_b$)" is a normalization factor which depends on $\kappa_b$. As indicated in FIG. 16, the templates $TP_\gamma$ are formed of factors $\delta_{\gamma,b}$ which are to be multiplied by the BPM feature values $XB_b$ ($t_i$) which form the BPM feature value XB ($t_i$). The templates $TP_\gamma$ are designed such that the factor $\delta_{\gamma,\gamma}$ is a global maximum, while each of the factor $\delta_{\gamma,2\gamma}$, the factor $\delta_{\gamma,3\gamma}$, . . . , the factor $\delta_{\gamma,}$ (*an integral multiple of* "γ"), is a local maximum. More specifically, the template $TP_{\gamma=2}$ is designed to fit musical pieces in which a beat exists in every two frames, for example. In this example, the templates TP are used for calculating the likelihoods P of the BPM feature values XB. Instead of the templates TP, however, a probability distribution function (such as multinomial distribution, Dirichlet distribution, multidimensional normal distribution, and multidimensional Poisson distribution) may be used.

Figure 13:
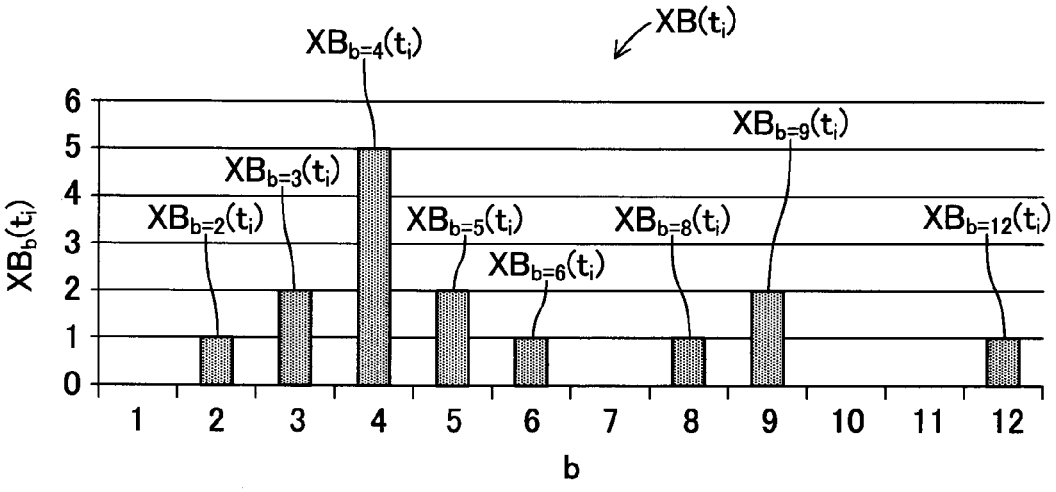
FIG. 13 is a graph indicative of calculated results of BPM feature values.
Figures 17, 18:
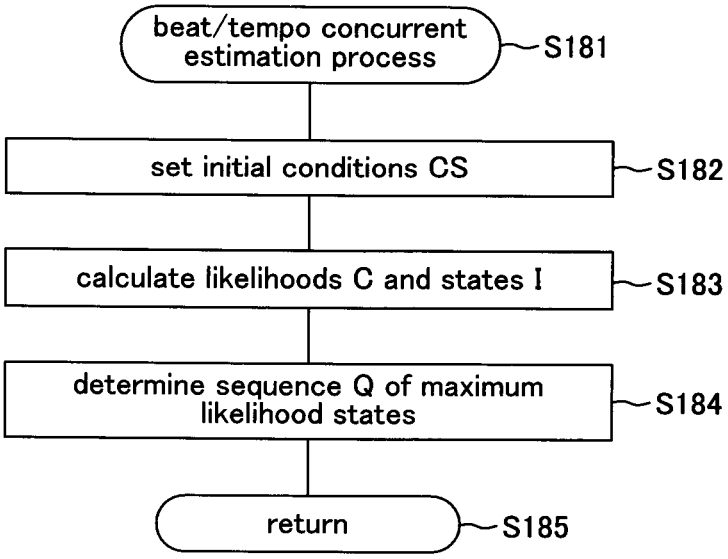
FIG. 17 is a chart indicative of calculated results of observation likelihood of BPM feature value.
FIG. 18 is a flowchart of a beat/tempo concurrent estimation program.

FIG. 17 exemplifies results of log calculation by calculating the likelihoods $P(XB(t_i)|Z_{b,n}(t_i))$ by use of the templates $TP_\gamma\{\gamma=1, 2, \ldots\}$ indicated in FIG. 16 in a case where the BPM feature values $XB(t_i)$ are values as indicated in FIG. 13. In this example, since the likelihood $P(XB(t_i)|Z_{b=4,n}(t_i))$ is the maximum, the BPM feature value XB (t) best fits the template $TP_4$.

At step S174, the CPU 12*a* combines the log of the likelihood $P(XO(t_i)|Z_{b,n}(t_i))$ and the log of the likelihood $P(XB(t_i)|Z_{b,n}(t_i))$ and define the combined result as log observation likelihood $L_{b,n}(t_i)$. The same result can be similarly obtained by defining, as the log observation likelihood $L_{b,n}(t_i)$, a log of a result obtained by combining the likelihood $P(XO)(t_i)|Z_{b,n}(t_i))$ and the likelihood $P(XB(t_i)|Z_{b,n}(t_i))$. At step S175, the CPU 12*a* terminates the log observation likelihood calculation process to proceed to step S180 of the sound signal analysis process (main routine).

At step S180, the CPU 12*a* reads out the beat/tempo concurrent estimation program indicated in FIG. 18 from the ROM 12*b*, and executes the program. The beat/tempo concurrent estimation program is a subroutine of the sound signal analysis program. The beat/tempo concurrent estimation program is a program for calculating a sequence Q of the maximum likelihood states by use of Viterbi algorithm. Hereafter, the program will be briefly explained. As a likelihood $C_{b,n}(t_i)$, first of all, the CPU 12*a* stores the likelihood of state $q_{b,n}$ in a case where a sequence of the likelihood is selected as if the state $q_{b,n}$ of frames $t_i$ is maximum when the onset feature values XO and the BPM feature values XB are observed from frame $t_0$ to frame $t_i$. As a state $I_{b,n}(t_i)$, furthermore, the CPU 12*a* also stores a state (state immediately before transition) of a frame immediately preceding the transition to the state $q_{b,n}$, respectively. More specifically, if a state after a transition is a state $q_{b=\beta e,n=\eta e}$, with a state before the transition being a state $q_{b=\beta s,n=\eta s}$, a state $I_{b=\beta e,n=\eta e}(t_i)$ is the state $q_{b=\beta s,n=\eta s}$. The CPU 12*a* calculates the likelihoods C and the states I until the CPU 12*a* reaches frame $t_{last}$, and selects the maximum likelihood sequence Q by use of the calculated results.

In a concrete example which will be described later, it is assumed for the sake of simplicity that the value of the beat period b of musical pieces which will be analyzed is "3", "4", or "5". As a concrete example, more specifically, procedures of the beat/tempo concurrent estimation process of a case where the log observation likelihoods $L_{b,n}(t_i)$ are calculated as exemplified in FIG. 19 will be explained. In this example, it is assumed that the observation likelihoods of states where the value of the beat period b is any value other than "3", "4" and "5" are sufficiently small, so that the observation likelihoods of the cases where the beat period b is any value other than "3", "4" and "5" are omitted in FIGS. 19 to 21. In this example, furthermore, the values of log transition probability T from a state where the value of the beat period b is "βs" with the value of the number n of frames "ηs" to a state where the value of the beat cycle b is "βe" with the value of the number n of frames "ηe" are set as follows: if "ηe=0", "βe=βs", and "ηe=βe−1", the value of log transition probability T is "−0.2". If "ηs=0", "βe=βs+1", and "ηe=βe−1", the value of log transition probability T is "−0.6". If "ηs=0", "βe=βs−1", and "ηe=βe−1", the value of log transition probability T is "−0.6". If "ηs>0", "βe=βs", and "ηe=ηs−1", the value of log transition probability T is "0". The value of log transition probability T of cases other than the above-described cases is "−∞". More specifically, at the transition from the state (ηs=0) where the value of the number n of frames is "0" to the next state, the value of the beat period b increases or decreases by "1". At this transition, furthermore, the value of the number n of frames is set at a value which is smaller by "1" than the post-transition beat period value b. At the transition from the state (ηs≠0) where the value of the number n of frames is not "0" to the next state, the value of the beat period b will not be changed, but the value of the number n of frames decreases by "1".

Hereafter, the beat/tempo concurrent estimation process will be explained concretely. At step S181, the CPU 12*a* starts the beat/tempo concurrent estimation process. At step S182, by use of the input operating elements 11, the user inputs initial conditions $CS_{b,n}$ of the likelihoods C corresponding to the respective states $q_{b,n}$ as indicated in FIG. 20. The initial conditions $CS_{b,n}$ may be stored in the ROM 12*b* so that the CPU 12*a* can read out the initial conditions $CS_{b,n}$ from the ROM 12*b*.

At step S183, the CPU 12*a* calculates the likelihoods $C_{b,n}(t_i)$ and the states $I_{b,n}(t_i)$. The likelihood $C_{b=\beta e,n=\eta e}(t_0)$ of the state a $q_{b=\beta e,n=\eta e}$ where the value of the beat cycle b is "βe" at frame $t_0$ with the value of the number n of frames being "ηe" can be obtained by combining the initial condition $CS_{b=\beta e,n=\eta e}$ and the log observation likelihood $L_{b=\beta e,n=\eta e}(t_0)$.

Furthermore, at the transition from the state $q_{b=s,n=\eta s}$ to the state $q_{b=\beta e,n=\eta e}$, the likelihoods $C_{b=\beta e,n=\eta e}(t_i)$ {i>0} can be calculated as follows. If the number n of frames of the state $q_{b=\beta s=\eta s}$ is not "0" (that is, ηe≠0), the likelihood $C_{b=\beta e,n=\eta e}(t_i)$ is obtained by combining the likelihood $C_{b=\beta e,n=\eta e+1}(t_{i-1})$, the log observation likelihood $L_{b=\beta e,n=\eta e}(t_i)$, and the log transition probability T. In this embodiment, however, since the log transition probability T of a case where the number n of frames of a state which precedes a transition is not "0" is "0", the likelihood $C_{b=\beta e,n=\eta e}(t_i)$ is substantially obtained by combining the likelihood $C_{b=\beta e,n=\eta e+1}(t_{i-1})$ and the log observation likelihood $L_{b=\beta e,n=\eta e}(t_i)$ ($C_{b=\beta e,n=\eta e}(t_i)=C_{b=\beta e,n=\beta e+1}(t_{i-1})+L_{b=\beta e,n=\eta e}(t_i)$). In this case, furthermore, the state $I_{b=\beta e,n=\eta e}(t_i)$ is the state $q_{b=\beta e,\eta e+1}$. In an example where the likelihoods C are calculated as indicated in FIG. 20, for example, the value of the likelihood $C_{4,1}(t_2)$ is "−0.3", while the value of the log observation likelihood $L_{4,0}(t_3)$ is "1.1". Therefore, the likelihood $C_{4,0}(t_3)$ is "0.8". As indicated in FIG. 21, furthermore, the state $I_{4,0}(t_3)$ is the state $q_{4,1}$.

Furthermore, the likelihood $C_{b=\beta e,n=\eta e}(t_i)$ of a case where the number n of frames of the state $q_{b=\beta s,n=\eta s}$ is "0" (ηs=0) is calculated as follows. In this case, the value of the beat period b can increase or decrease with state transition. Therefore, the log transition probability T is combined with the likelihood $C_{\beta e-1,0}(t_{i-1})$, the likelihood $C_{\beta e,0}(t_{i-1})$ and the likelihood $C_{\beta e+1,0}(t_{i-1})$, respectively. Then, the maximum value of the combined results is further combined with the log observation likelihood $L_{b=\beta e,n=\eta e}(t_i)$ to define the combined result as the likelihood $C_{b=\beta e,n=\eta e}(t_i)$. Furthermore, the state $I_{b=\beta e,n=\eta e}(t_i)$ is a state q selected from among state $q_{\beta e-1,0}$, state $q_{\beta e,0}$, and state $q_{\beta e+1,0}$. More specifically, the log transition probability T is added to the likelihood $C_{\beta e-1,0}(t_{i-1})$, the likelihood $C_{\beta e,0}(t_{i-1})$ and the likelihood $C_{\beta e+1,0}(t_{i-1})$ of the state $q_{\beta e-1,0}$, state $q_{\beta e,0}$, and state $q_{\beta e+1,0}$, respectively, to select a state having the largest added value to define the selected state as the state $I_{b=\beta e,n=\eta e}(t_i)$. More strictly, the likelihoods $C_{b,n}(t)$ have to be normalized. Even without normalization, however, the results of estimation of beat positions and changes in tempo are mathematically the same.

For instance, the likelihood $C_{4,3}$ ($t_3$) is calculated as follows. Since in a case where a state preceding a transition is state $q_{3,0}$, the value of the likelihood $C_{3,0}$ ($t_2$) is "0.0" with the log transition probability T being "−0.6", a value obtained by combining the likelihood $C_{3,0}$ ($t_2$) and the log transition probability T is "−0.6". Furthermore, since in a case where a state preceding a transition is state $q_{4,0}$, the value of the likelihood $C_{4,0}$ ($t_2$) preceding the transition is "−1.2" with the log transition probability T being "−0.2", a value obtained by combining the likelihood $C_{4,0}$ ($t_2$) and the log transition probability T is "−1.4". Furthermore, since in a case where a state preceding a transition is state $q_{5,0}$, the value of the likelihood $C_{5,0}$ ($t_2$) preceding the transition is "−1.2" with the log transition probability T being "−0.6", a value obtained by combining the likelihood $C_{5,0}$ ($t_2$) and the log transition probability T is "−1.8". Therefore, the value obtained by combining the likelihood $C_{3,0}$ ($t_2$) and the log transition probability T is the largest. Furthermore, the value of the log observation likelihood $L_{4,3}$ ($t_3$) is "−1.1". Therefore, the value of the likelihood $C_{4,3}$ ($t_3$) is "−1.7" (=−0.6+(−1.1)), so that the state $I_{4,3}$ ($t_3$) is the state $q_{3,0}$.

When completing the calculation of likelihoods $C_{b,n}$ ($t_i$) and the states $I_{b,n}$ ($t_i$) of all the states $q_{b,n}$ for all the frames $t_i$, the CPU 12*a* proceeds to step S184 to determine the sequence Q of the maximum likelihood states (={$q_{max}$ ($t_0$), $q_{max}$ ($t_1$), . . . , $q_{max}$ ($t_{last}$)}) as follows. First, the CPU 12*a* defines a state $q_{b,n}$ which is in frame $t_{last}$ and has the maximum likelihood $C_{b,n}$ ($t_{last}$) as a state $q_{max}$ ($t_{last}$). The value of the beat period b of the state $q_{max}$ ($t_{last}$) is denoted as "βm", while the value of the number n of frames is denoted as "ηm". More specifically, the state $I_{\beta m,\eta m}$ ($t_{last}$) is a state $q_{max}$ ($t_{last-1}$) of the frame $t_{last-1}$ which immediately precedes the frame $t_{last}$. The state $q_{max}$ ($t_{last-2}$), the state $q_{max}$ ($t_{last-3}$), . . . of frame $t_{last-2}$, frame $t_{last-3}$, . . . are also determined similarly to the state $q_{max}$ ($t_{last-1}$). More specifically, the state ($t_{i+1}$) where the value of the beat period b of a state $q_{max}$ ($t_{i+1}$) of frame $t_{i+1}$ is denoted as "βm" with the value of the number n of frames being denoted as "ηm" is the state $q_{max}$ ($t_i$) of the frame $t_i$ which immediately precedes the frame $t_{i+1}$. As described above, the CPU 12*a* sequentially determines the states $q_{max}$ from frame $t_{last-1}$ toward frame $t_0$ to determine the sequence Q of the maximum likelihood states.

In the example shown in FIG. 20 and FIG. 21, for example, in the frame $t_{last=77}$, the likelihood $C_{5,1}$ ($t_{last=77}$) of the state $q_{5,1}$ is the maximum. Therefore, the state $q_{max}$ ($t_{last=77}$) is the state $q_{5,1}$. According to FIG. 21, since the state $I_{5,1}$ ($t_{77}$) is the state $q_{5,2}$, the state $q_{max}$ ($t_{76}$) the state $q_{5,2}$. Furthermore, since the state $I_{5,2}$ ($t_{76}$) is the state $q_{5,3}$, the state $q_{max}$ ($t_{75}$) is the state $q_{5,3}$. States $q_{max}$ ($t_{74}$) to $q_{max}$ ($t_0$) are also determined similarly to the state $q_{max}$ ($t_{76}$) and the state $q_{max}$ ($t_{75}$). As described above, the sequence Q of the maximum likelihood states indicated by arrows in FIG. 20 is determined. In this example, the value of the beat period b is first estimated as "3", but the value of the beat period b changes to "4" near frame $t_{40}$, and further changes to "5" near frame $t_{44}$. In the sequence Q, furthermore, it is estimated that a beat exists in frames $t_0$, $t_3$, . . . corresponding to states $q_{max}$ ($t_0$), $q_{max}$ ($t_3$), . . . where the value of the number n of frames is "0".

At step S185, the CPU 12*a* terminates the beat/tempo concurrent estimation process to proceed to step S190 of the sound signal analysis process (main routine).

Figure 23:
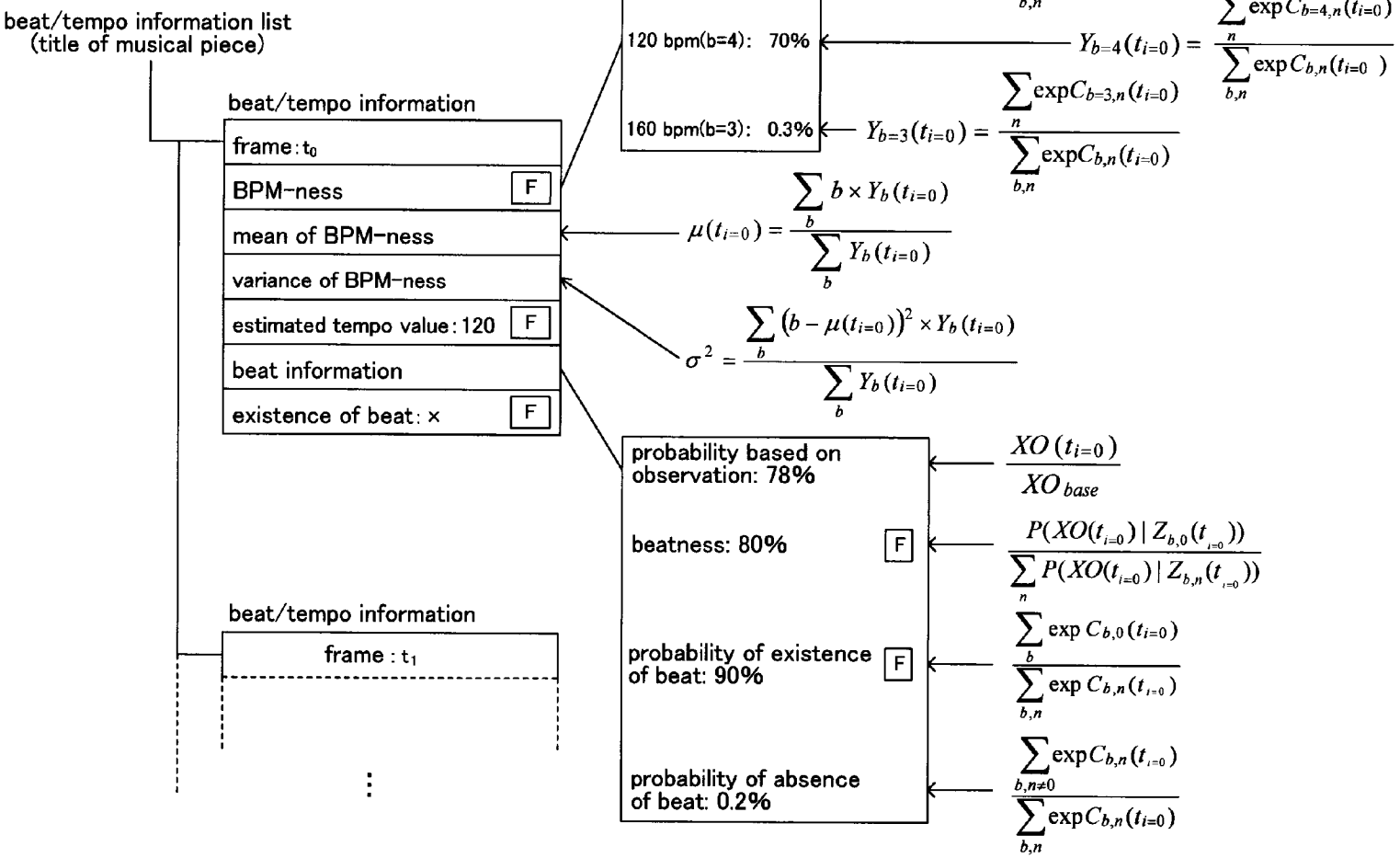
FIG. 23 is a schematic diagram schematically indicating a beat/tempo information list.

At step S190, the CPU 12*a* calculates "BPM-ness", "mean of "BPM-ness", "variance of BPM-ness", "probability based on observation", "beatness", "probability of existence of beat", and "probability of absence of beat" for each frame $t_i$ (see expressions indicated in FIG. 23). The "BPM-ness" represents a probability that a tempo value in frame $t_i$ is a value corresponding to the beat period b. The "BPM-ness" is obtained by normalizing the likelihood $C_{b,n}$ ($t_i$) and marginalizing the number n of frames. More specifically, the "BPM-ness" of a case where the value of the beat period b is "β" is a ratio of the sum of the likelihoods C of the states where the value of the beat period b is "β" to the sum of the likelihoods C of all states in frame $t_i$. The "mean of BPM-ness" is obtained by multiplying the respective "BPM-nesses" corresponding to the respective values of beat period b by respective values of the beat periods b in frame $t_i$ and dividing a value obtained by combining the multiplied results by a value obtained by combining all the "BPM-nesses" of frame $t_i$. The "variance of BPM-ness" is calculated as follows. First, the "mean of BPM-ness" in frame $t_i$ is subtracted from the respective values of the beat period b to raise respective subtracted results to the second power to multiply the respective raised results by the respective values of "BPM-ness" corresponding to the respective values of the beat period b. Then, a value obtained by combining the respective multiplied results is divided by a value obtained by combining all the "BPM-nesses" of frame $t_i$ to obtain the "variance of BPM-ness". Respective values of the above-calculated "BPM-ness", "mean of BPM-ness" and "variance of BPM-ness" are exemplified in FIG. 22. The "probability based on observation" represents a probability calculated on the basis of observation values (i.e., onset feature values XO) where a beat exists in frame $t_i$. More specifically, the "probability based on observation" is a ratio of onset feature value XO ($t_i$) to a certain reference value $XO_{base}$. The "beatness" is a ratio of the likelihood P (XO ($t_i$)|$Z_{b,0}$ ($t_i$)) to a value obtained by combining the likelihoods P (XO ($t_i$)|$Z_{b,n}$ ($t_i$)) of onset feature values XO ($t_i$) of all values of the number n of frames. The "probability of existence of beat" and "probability of absence of beat" are obtained by marginalizing the likelihood $C_{b,n}$ ($t_i$) for the beat period b. More specifically, the "probability of existence of beat" is a ratio of a sum of the likelihoods C of states where the value of the number n of frames is "0" to a sum of the likelihoods C of all states in frame $t_i$. The "probability of absence of beat" is a ratio of a sum of the likelihoods C of states where the value of the number n of frames is not "0" to a sum of the likelihoods C of all states in frame $t_i$.

Figure 24:
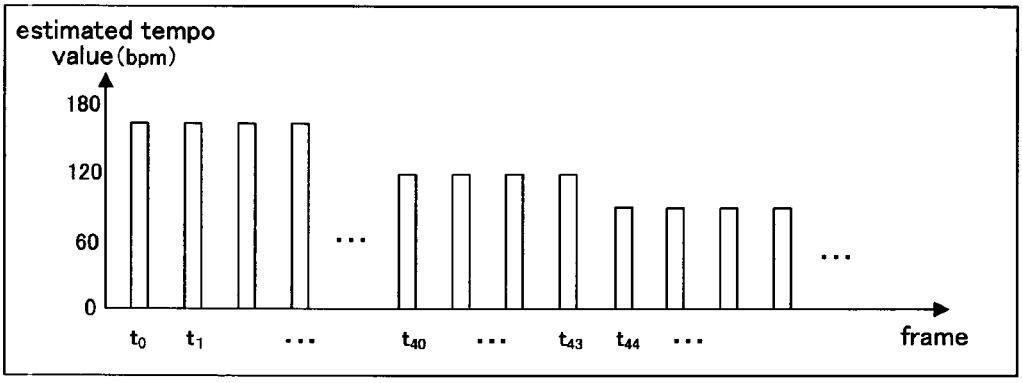
FIG. 24 is a graph indicative of changes in tempo.
Figure 25:
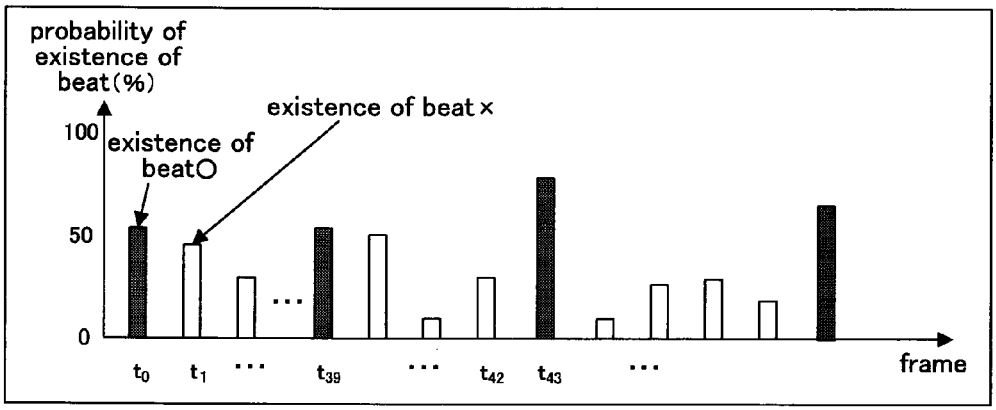
FIG. 25 is a graph indicative of beat positions.
Figure 26:
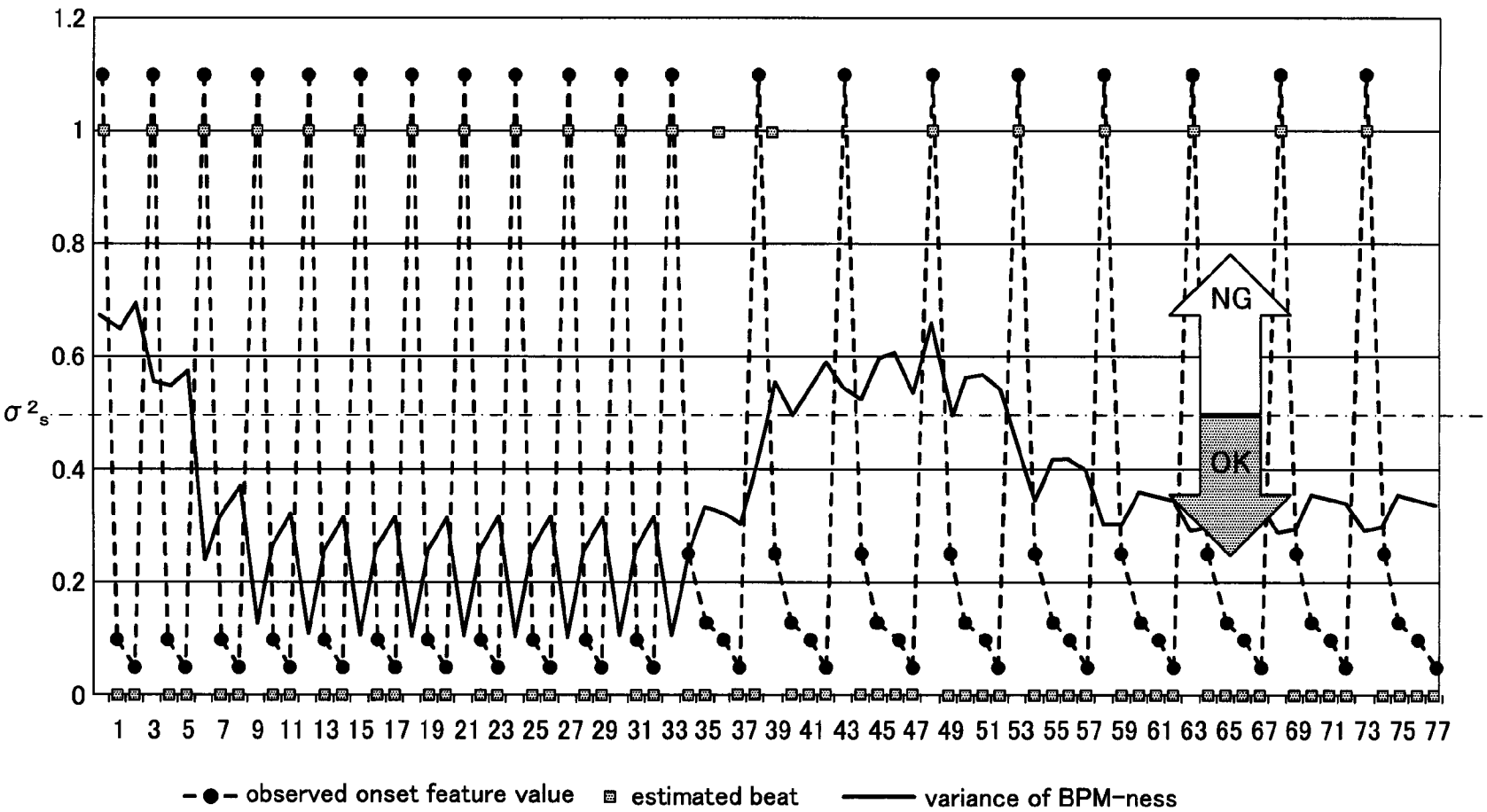
FIG. 26 is a graph indicative of changes in onset feature value, beat position and variance of BPM-ness.

By use of the "BPM-ness", "probability based on observation", "beatness", "probability of existence of beat", and "probability of absence of beat", the CPU 12*a* displays a beat/tempo information list indicated in FIG. 23 on the display unit 13. On an "estimated tempo value (BPM)" field of the list, a tempo value (BPM) corresponding to the beat period b having the highest probability among those included in the above-calculated "BPM-ness" is displayed. On an "existence of beat" field of the frame which is included in the above-determined states $q_{m'}$ ($t_i$) and whose value of the number n of frames is "0", "0" is displayed. On the "existence of beat" field of the other frames, "x" is displayed. By use of the estimated tempo value (BPM), furthermore, the CPU 12*a* displays a graph indicative of changes in tempo as shown in FIG. 24 on the display unit 13. The example shown in FIG. 24 represents changes in tempo as a bar graph. In the example explained with reference to FIG. 20 and FIG. 21, although the value of the beat period b starts with "3", the value of the beat period b changes to "4" at frame $t_{40}$, and further changes to "5" at frame $t_{44}$. Therefore, the user can visually recognize changes in tempo. By use of the above-calculated "probability of existence of beat", furthermore, the CPU 12*a* displays a graph indicative of beat positions as indicated in FIG. 25 on the display unit 13. By use of the above-calculated "onset feature value XO", "variance of BPM-ness" and "existence of beat", furthermore, the CPU 12*a* displays a graph indicative of stability of tempo as indicated in FIG. 26 on the display unit 13.

Furthermore, in a case where existing data has been found by the search for existing data at step S130 of the sound signal analysis process, the CPU 12*a* displays the beat/tempo information list, the graph indicative of changes in tempo, and the graph indicative of beat positions and tempo stability on the display unit 13 at step S190 by use of various kinds of data on the previous analysis results read into the RAM 12*c* at step S150.

At step S200, the CPU 12*a* displays a message asking whether the user desires to start reproducing the musical piece or not on the display unit 13, and waits for user's instructions. Using the input operating elements 11, the user instructs either to start reproduction of the musical piece or to execute a later-described beat/tempo information correction process. For instance, the user clicks on an icon which is not shown with a mouse.

If the user has instructed to execute the beat/tempo information correction process at step S200, the CPU 12*a* determines "No" to proceed to step S210 to execute the beat/tempo information correction process. First, the CPU 12*a* waits until the user completes input of correction information. Using the input operating elements 11, the user inputs a corrected value of the "BPM-ness", "probability of existence of beat" or the like. For instance, the user selects a frame that the user desires to correct with the mouse, and inputs a corrected value with the numeric keypad. Then, a display mode (color, for example) of "F" located on the right of the corrected item is changed in order to explicitly indicate the correction of the value. The user can correct respective values of a plurality of items. On completion of input of corrected values, the user informs of the completion of input of correction information by use of the input operating elements 11. Using the mouse, for example, the user clicks on an icon which is not shown but indicates completion of correction. The CPU 12*a* updates either of or both of the likelihood $P(XO(t_i)|Z_{b,n}(t_i))$ and the likelihood $P(XB(t_i)|Z_{b,n}(t_i))$ in accordance with the corrected value. For instance, in a case where the user has corrected such that the "probability of existence of beat" in frame t is raised with the value of the number n of frames on the corrected value being "ηe", the CPU 12*a* sets the likelihood $P(XB(t_i)|Z_{b,n\neq\eta e}(t_i))$ at a value which is sufficiently small. At frame $t_i$ as a result, the probability that the value of the number n of frames is "ηe" is relatively the highest. For instance, furthermore, in a case where the user has corrected the "BPM-ness" of frame t such that the probability that the value of the beat period b is "βe" is raised, the CPU 12*a* sets the likelihoods $P(XB(t_i)|Z_{b\neq\beta e,n}(t_i))$ of states where the value of the beat period b is not "βe" at a value which is sufficiently small. At frame $t_i$, as a result, the probability that the value of the beat period b is "βe" is relatively the highest. Then, the CPU 12*a* terminates the beat/tempo information correction process to proceed to step S180 to execute the beat/tempo concurrent estimation process again by use of the corrected log observation likelihoods L.

If the user has instructed to start reproduction of the musical piece, the CPU 12*a* determines "Yes" to proceed to step S220 to store various kinds of data on results of analysis of the likelihoods C, the states I, and the beat/tempo information list in the storage device 14 so that the various kinds of data are associated with the title of the musical piece.

Figure 27:
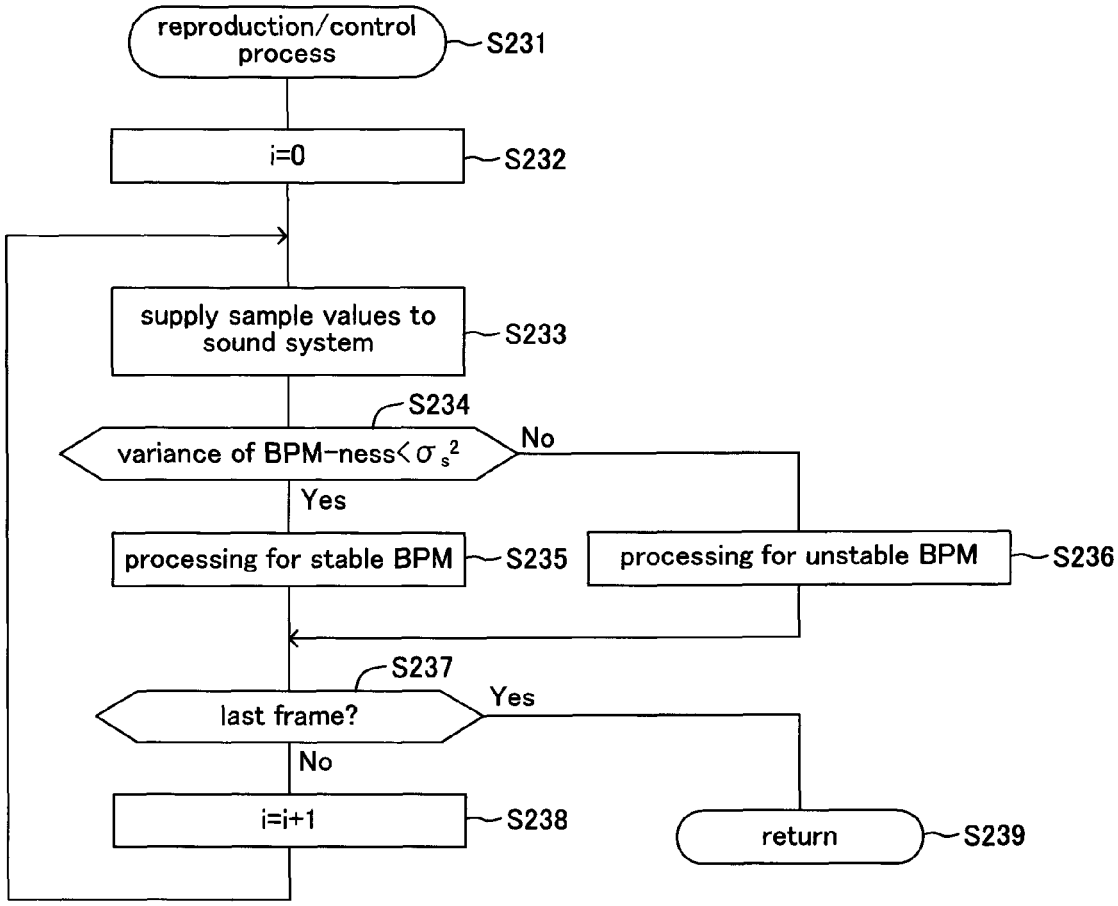
FIG. 27 is a flowchart of a reproduction/control program.

At step S230, the CPU 12*a* reads out a reproduction/control program indicated in FIG. 27 from the ROM 12*b*, and executes the program. The reproduction/control program is a subroutine of the sound signal analysis program.

At step S231, the CPU 12*a* starts a reproduction/control process. At step S232, the CPU 12*a* sets frame number i indicative of a frame which is to be reproduced at "0". At step S233, the CPU 12*a* transmits the sample values of frame $t_i$ to the sound system 16. Similarly to the first embodiment, the sound system 16 reproduces a section corresponding to frame $t_i$ of the musical piece by use of the sample values received from the CPU 12*a*. At step S234, the CPU 12*a* judges whether or not the "variance of BPM-ness" of frame $t_i$ is smaller than a predetermined reference value $\sigma_s^2$ (0.5, for example). If the "variance of BPM-ness" is smaller than the reference value $\sigma_s^2$, the CPU 12*a* determines "Yes" to proceed to step S235 to carry out predetermined processing for stable BPM. If the "variance of BPM-ness" is equal to or greater than the reference value $\sigma_s^2$, the CPU 12*a* determines "No" to proceed to step S236 to carry out predetermined processing for unstable BPM. Since steps S235 and S236 are similar to steps S18 and S19 of the first embodiment, respectively, the explanation about steps S235 and S236 will be omitted. In an example of FIG. 26, the "variance of BPM-ness" is equal to or greater than the reference value $\sigma_s^2$ from frame $t_{39}$ to frame $t_{53}$. In the example of FIG. 26, therefore, the CPU 12*a* carries out the processing for unstable BPM in frames $t_{40}$ to $t_{53}$ at step S236. In a top few frames, the "variance of BPM-ness" tends to be greater than the reference value $\sigma_s^2$ even if the beat period b is constant. Therefore, the reproduction/control process may be configured such that the CPU 12*a* carries out the processing for stable BPM in the top few frames at step S235.

At step S237, the CPU 12*a* judges whether the currently processed frame is the last frame or not. More specifically, the CPU 12*a* judges whether the value of the frame number i is "last" or not. If the currently processed frame is not the last frame, the CPU 12*a* determines "No", and increments the frame number i at step S238. After step S238, the CPU 12*a* proceeds to step S233 to carry out the sequence of steps S233 to S238 again. If the currently processed frame is the last frame, the CPU 12*a* determines "Yes" to terminate the reproduction/control process at step S239 to return to the sound signal analysis process (main routine) to terminate the sound signal analysis process at step S240. As a result, the sound signal analysis apparatus 10 can control the external apparatus EXT, the sound system 16 and the like, also enabling smooth reproduction of the musical piece from the top to the end of the musical piece.

The sound signal analysis apparatus 10 according to the second embodiment can select a probability model of the most likely sequence of the log observation likelihoods L calculated by use of the onset feature values XO relating to beat position and the BPM feature values XB relating to tempo to concurrently (jointly) estimate beat positions and changes in tempo in a musical piece. Therefore, the sound signal analysis apparatus 10 can enhance accuracy of estimation of tempo, compared with a case where beat positions of a musical piece are figured out by calculation to obtain tempo by use of the calculation result.

Furthermore, the sound signal analysis apparatus 10 according to the second embodiment controls the target in accordance with the value of the "variance of BPM-ness". More specifically, if the value of the "variance of BPM-ness" is equal to or greater than the reference value $\sigma_s^2$, the sound signal analysis apparatus 10 judges that the reliability of the tempo value is low, and carries out the processing for unstable tempo. Therefore, the sound signal analysis apparatus 10 can prevent a problem that the rhythm of a musical piece cannot synchronize with the action of the target when the tempo is unstable. As a result, the sound signal analysis apparatus 10 can prevent unnatural action of the target.

Furthermore, the present invention is not limited to the above-described embodiments, but can be modified variously without departing from object of the invention.

For example, although the first and second embodiments are designed such that the sound signal analysis apparatus 10 reproduces a musical piece, the embodiments may be modified such that an external apparatus reproduces a musical piece.

Furthermore, the first and second embodiments are designed such that the tempo stability is evaluated on the basis of two grades: whether the tempo is stable or unstable. However, the tempo stability may be evaluated on the basis of three or more grades. In this modification, the target may be controlled variously, depending on the grade (degree of stability) of the tempo stability.

In the first embodiment, furthermore, four unit sections are provided as judgment sections. However, the number of unit sections may be either more or less than four. Furthermore, the unit sections selected as judgment sections may not be consecutive in time series. For example, the unit sections may be selected alternately in time series.

In the first embodiment, furthermore, the tempo stability is judged on the basis of differences in tempo between neighboring unit sections. However, the tempo stability may be judged on the basis of a difference between the largest tempo value and the smallest tempo value of judgment sections.

Furthermore, the second embodiment selects a probability model of the most likely observation likelihood sequence indicative of probability of concurrent observation of the onset feature values XO and the BPM feature values XB as observation values. However, criteria for selection of probability model are not limited to those of the embodiment. For instance, a probability model of maximum a posteriori distribution may be selected.

In the second embodiment, furthermore, the tempo stability of each frame is judged on the basis of the "variance of BPM-ness" of each frame. By use of respective estimated tempo values of frames, however, the amount of change in tempo in the frames may be calculated to control the target in accordance with the calculated result, similarly to the first embodiment.

In the second embodiment, furthermore, the sequence Q of maximum likelihood states is calculated to determine the existence/absence of a beat and a tempo value in each frame. However, the existence/absence of a beat and the tempo value in a frame may be determined on the basis of the beat period b and the value of the number n of frames of a state $q_{b,n}$ corresponding to the maximum likelihood C included in the likelihoods C of the frame $t_i$. This modification can reduce time required for analysis because the modification does not need calculation of the sequence Q of maximum likelihood states.

Furthermore, the second embodiment is designed, for the sake of simplicity, such that the length of each frame is 125 ms. However, each frame may have a shorter length (e.g., 5 ms). The reduced frame length can contribute improvement in resolution relating to estimation of beat position and tempo. For example, the enhanced resolution enables tempo estimation in increments of 1 BPM.

What is claimed is:

1. A sound signal analysis apparatus comprising:

at least one non-transitory memory device;

at least one processor;

a sound signal input portion for inputting a sound signal indicative of a musical piece;

a tempo detection portion for detecting a tempo of each of sections of the musical piece by use of the input sound signal;

a judgment portion for judging stability of the tempo; and a control portion for controlling a certain target in accordance with a result judged by the judgment portion, wherein the tempo detection portion has:

a feature value calculation portion for calculating a first feature value indicative of a feature relating to existence of a beat and a second feature value indicative of a feature relating to tempo for each of the sections of the musical piece; and an estimation portion for concurrently estimating a beat position and a change in tempo in the musical piece by selecting, from among a plurality of probability models described as sequences of states classified according to a combination of a physical quantity relating to existence of a beat in each of the sections and a physical quantity relating to tempo in each of the sections, a probability model whose sequence of observation likelihoods each indicative of a probability of concurrent observation of the first feature value and the second feature value in the each section satisfies a certain criterion, wherein the sound signal input portion, the tempo detection portion, the judgment portion, and the control portion are implemented at least in part by the at least one processor executing at least one program recorded on the at least one non-transitory memory device.

2. The sound signal analysis apparatus according to claim 1, wherein the estimation portion concurrently estimates a beat position and a change in tempo in the musical piece by selecting a probability model of the most likely sequence of observation likelihoods from among the plurality of probability models.

3. The sound signal analysis apparatus according to claim 1, wherein the estimation portion has first probability output portion for outputting, as a probability of observation of the first feature value, a probability calculated by assigning the first feature value as a probability variable of a probability distribution function defined according to the physical quantity relating to existence of beat.

4. The sound signal analysis apparatus according to claim 3, wherein as a probability of observation of the first feature value, the first probability output portion outputs a probability calculated by assigning the first feature value as a probability variable of any one of normal distribution, gamma distribution and Poisson distribution defined according to the physical quantity relating to existence of beat.

5. The sound signal analysis apparatus according to claim 1, wherein the estimation portion has second probability output portion for outputting, as a probability of observation of the second feature value, goodness of fit of the second feature value to a plurality of templates provided according to the physical quantity relating to tempo.

6. The sound signal analysis apparatus according to claim 1, wherein the estimation portion has second probability output portion for outputting, as a probability of observation of the second feature value, a probability calculated by assigning the second feature value as a probability variable of probability distribution function defined according to the physical quantity relating to tempo.

7. The sound signal analysis apparatus according to claim 6, wherein as a probability of observation of the second feature value, the second probability output portion outputs a probability calculated by assigning the first feature value as a probability variable of any one of multinomial distribution, Dirichlet distribution, multidimensional normal distribution, and multidimensional Poisson distribution defined according to the physical quantity relating to existence of beat.

8. The sound signal analysis apparatus according to claim 1, wherein the judgment portion calculates likelihoods of the respective states in the respective sections in accordance with the first feature value and the second feature value observed from the top of the musical piece to the respective sections, and judges stability of tempo in the respective sections in accordance with the distribution of likelihoods of the respective states in the respective sections.

9. The sound signal analysis apparatus according to claim 1, wherein the judgment portion judges that the tempo is stable if an amount of change in tempo between the sections falls within a predetermined range, while the judgment portion judges that the tempo is unstable if the amount of change in tempo between the sections is outside the predetermined range.

10. The sound signal analysis apparatus according to claim 1, wherein the control portion makes the target operate in a predetermined first mode in the section where the tempo is stable, while the control portion makes the target operate in a predetermined second mode in the section where the tempo is unstable.

11. A sound signal analysis method comprising:

inputting a sound signal indicative of a musical piece;

detecting a tempo of each of sections of the musical piece by use of the input sound signal;

judging a stability of the tempo; and controlling a certain target in accordance with the judged stability of the tempo, wherein detecting the tempo includes:

calculating a first feature value indicative of a feature relating to existence of a beat and a second feature value indicative of a feature relating to tempo for each of the sections of the musical piece; and concurrently estimating a beat position and a change in tempo in the musical piece by selecting, from among a plurality of probability models described as sequences of states classified according to a combination of a physical quantity relating to existence of a beat in each of the sections and a physical quantity relating to tempo in each of the sections, a probability model whose sequence of observation likelihoods each indicative of a probability of concurrent observation of the first feature value and the second feature value in the each section satisfies a certain criterion.

12. A non-transitory computer readable storage medium storing a sound signal analysis program configured to cause a computer to execute a sound signal analysis method comprising:

inputting a sound signal indicative of a musical piece;

detecting a tempo of each of sections of the musical piece by use of the input sound signal;

judging a stability of the tempo; and controlling a certain target in accordance with the judged stability of the tempo, wherein detecting the tempo includes:

calculating a first feature value indicative of a feature relating to existence of a beat and a second feature value indicative of a feature relating to tempo for each of the sections of the musical piece; and concurrently estimating a beat position and a change in tempo in the musical piece by selecting, from among a plurality of probability models described as sequences of states classified according to a combination of a physical quantity relating to existence of a beat in each of the sections and a physical quantity relating to tempo in each of the sections, a probability model whose sequence of observation likelihoods each indicative of a probability of concurrent observation of the first feature value and the second feature value in the each section satisfies a certain criterion.

13. An apparatus comprising:

at least one non-transitory memory device;

at least one processor;

an interface circuit configured to communicate with an external apparatus;

musical piece data indicative of a musical piece stored on the at least one non-transitory memory device;

a sound signal input unit configured to input a sound signal indicative of the musical piece;

a tempo detection unit configured to detect a tempo of each of sections of the musical piece by use of the input sound signal;

a judgment unit configured to judge a stability of the tempo; and a control unit configured to control the external apparatus in accordance with a result judged by the judgment unit, wherein the sound signal input unit, the tempo detection unit, the judgment unit, and the control unit are implemented at least in part by the at least one processor executing at least one program recorded on the at least one non-transitory memory device.

14. The apparatus according to claim 13, wherein the judgment unit is configured to determine that the tempo is stable if an amount of change in tempo between adjacent sections is less than a threshold value and to determine that the tempo is unstable if the amount of change in tempo between the adjacent sections exceeds the threshold value.

15. The apparatus according to claim 13, wherein the control unit causes the external apparatus to operate in a first mode in the section where the tempo is stable and to operate in a second mode in the section where the tempo is unstable.

16. The apparatus according to claim 13, wherein the sections of the musical piece are sequentially recorded in successive addresses of the at least one non-transitory memory device.

* * * * *